US009368057B2

(12) United States Patent
Kimpe et al.

(10) Patent No.: US 9,368,057 B2
(45) Date of Patent: Jun. 14, 2016

(54) METHOD AND DEVICE FOR IMPROVED DISPLAY STANDARD CONFORMANCE

(75) Inventors: Tom Kimpe, Gent (BE); Etienne Dorval, Sint-Pieters-Leeuw (BE)

(73) Assignee: BARCO, N.V., Kortrijk (BE)

( * ) Notice: Subject to any disclaimer, the term of this patent is extended or adjusted under 35 U.S.C. 154(b) by 802 days.

(21) Appl. No.: 11/494,570

(22) Filed: Jul. 28, 2006

(65) Prior Publication Data

US 2007/0067124 A1 Mar. 22, 2007

Related U.S. Application Data

(60) Provisional application No. 60/703,877, filed on Aug. 1, 2005.

(51) Int. Cl.
*G09G 3/20* (2006.01)
*G09G 3/00* (2006.01)

(52) U.S. Cl.
CPC ..... *G09G 3/2092* (2013.01); *G09G 3/006* (2013.01); *G09G 2320/0242* (2013.01); *G09G 2320/0285* (2013.01); *G09G 2320/0693* (2013.01)

(58) Field of Classification Search
CPC ..... G09G 2320/028; G09G 2320/0276; G09G 2320/0693; G09G 3/2092; G09G 3/006; G09G 2320/0242; G09G 2320/0285
USPC ..... 345/204, 207, 690–699
See application file for complete search history.

(56) References Cited

U.S. PATENT DOCUMENTS

| | | | | |
|---|---|---|---|---|
| 4,386,345 | A * | 5/1983 | Narveson et al. | 345/22 |
| 4,654,706 | A | 3/1987 | Davidson et al. | |
| 6,954,193 | B1 * | 10/2005 | Andrade et al. | 345/90 |
| 2001/0038385 | A1 | 11/2001 | Negoi et al. | |
| 2003/0231192 | A1 | 12/2003 | Kaneyasu | |
| 2004/0174375 | A1 * | 9/2004 | Credelle et al. | 345/589 |
| 2005/0134525 | A1 | 6/2005 | Tanghe et al. | |
| 2006/0038807 | A1 * | 2/2006 | Eckhardt et al. | 345/207 |

FOREIGN PATENT DOCUMENTS

| | | | |
|---|---|---|---|
| EP | 0 204 112 | A2 | 12/1986 |
| EP | 1 548 573 | A1 | 6/2005 |
| WO | WO 01/80211 | A1 | 10/2001 |

OTHER PUBLICATIONS

Examination Report of the European Patent Office regarding European Patent application No. 06776418.3, Sep. 11, 2009.
Boaxin Li et al., "P-27: Adaptive Display Color Correction Based on Real-time Viewing Angle Estimation", *SID 04 Digest*, pp. 330-333, 2004.

(Continued)

*Primary Examiner* — Aneeta Yodichkas
*Assistant Examiner* — Saifeldin Elnafia
(74) *Attorney, Agent, or Firm* — Bacon & Thomas, PLLC

(57) ABSTRACT

The invention provides a new method to calibrate a display system such that the display system is conforming to an enforced standard for a wider range of parameters, e.g. viewing angles, than compared to traditional calibration methods. This is obtained by calculating an optimised set of calibration parameters for the display to be conform to the enforced standard for the selected range of parameters.

36 Claims, 17 Drawing Sheets

(56) References Cited

OTHER PUBLICATIONS

S.L. Wright et al., "17.4: Low-cost Method to Improve Viewing-Angle Characteristics of Twisted-Nematic Mode Liquid-Crystal Displays", *SID 02 Digest,* pp. 717-719, 2002.
*Digital Imaging and Communications in Medicine* (*DICOM*), *Part 14: Grayscale Standard Display Function,* National Electrical Manufacturers Association (Copyright 2006).
*Digital Imaging and Communications in Medicine* (*DICOM*), *Supplement 28: Grayscale Standard Display Function,* National Electrical Manufacturers Association (Copyright 1998).
Office Action issued in related European application No. 06 776 418.3 dated Jan. 5, 2011, 2 pages.
Examination Report of the European Patent Office in corresponding European Application No. 06776418.3, Jul. 30, 2012.

* cited by examiner

METHOD AND DEVICE FOR IMPROVED DISPLAY STANDARD CONFORMANCE

TECHNICAL FIELD OF THE INVENTION

The present invention relates to systems for testing displays, to systems for determining luminance levels and colour points of displays, to systems for calibrating displays, and to corresponding methods.

BACKGROUND OF THE INVENTION

It is known that calibration of a display (in medical imaging also called a soft-copy viewing station) is an important component of effective medical imaging (including imaging of anatomy, imaging for diagnostic or clinical use, etc.). In many cases, there are very small luminance or colour differences between an area of interest (which itself may be very small) and the surrounding area. Without proper display system calibration, it is possible that the viewing station itself can adversely affect the ability to make a proper diagnosis or interpretation of the image being displayed. Particularly when using an un-calibrated commercial colour monitor, the low-level shades of grey may be hard to distinguish from one another.

For medical images there have been several guidelines that have been developed for calibration. When the American College of Radiology (ACR) and National Electrical Manufacturers Association (NEMA) formed a joint committee to develop a Standard for Digital Imaging and Communications in Medicine (DICOM), they reserved Part 14 for the Grayscale Standard Display Function (GSDF). This standard defines a way to take the existing Characteristic Curve of a display system (i.e. the Luminance Output in function of each Digital Driving Level DDL or pixel value) and modify it to the Grayscale Standard Display Function. At the heart of the Grayscale Standard Display Function is the Barten Model. This model takes into account the perceptivity of the human eye. Given the black and white levels of the display system, it will spread out the luminance at each of the intermediary Digital Driving Levels such as to maximize the Just Noticeable Differences (JND) between each level. A JND is the luminance difference that a standard human observer can just perceive. Calibration has the aim that each DDL will be as distinguishable as possible from neighbouring levels, throughout the luminance range, and it will be consistent with other display systems that are similarly calibrated.

A part of DICOM, supplement 28, describes the GSDF in more detail (available at http://medical.nema.org/dicom/final/sup28_ft.pdf). It is a formula based on human perception of luminance and is also published as a table (going up to 4000 cd/m2). It also uses linear perceptions and JND. Steps to reach this GSDF on a medical display are named 'Characterization', 'Calibration' and afterwards a 'Conformance check'. These will be discussed in more detail below.

FIG. 8 and FIG. 9 are extracts from the document "DICOM/NEMA supplement 28 greyscale standard display function". FIG. 8 shows the principle of changing the global transfer curve of a display system to obtain a standardised display system 102 according to a standardised greyscale standard display function. In other words, the input-values 104, referred to as P-values 104, are converted by means of a "P-values to DDLs" conversion curve 106 to digital driving values or levels 108, referred to as DDL 108, in such a way that, after a subsequent "DDLs to luminance" conversion, the resulting curve "luminance versus P-values" 114 follows a specific standardised curve. The digital driving levels then are converted by a "DDLs to luminance" conversion curve 110 specific to the display system (native transfer curve of the display system) and thus allow a certain luminance output 112. This standardised luminance output curve is shown in FIG. 9, which is a combination of the "P-values to DDLs" conversion curve 106 and the "DDLs to luminance" curve 110. This curve is based on the human contrast sensitivity as described by the Barten's model. It is to be noted that it is clearly non-linear within the luminance range of medical displays. The greyscale standard display function is defined for the luminance range 0.05 cd/m$^2$ up to 4000 cd/m$^2$. The horizontal axis of FIG. 2 shows the index of the just noticeable differences, referred to as luminance JND, and the vertical axis shows the corresponding luminance values. A luminance JND represents the smallest variation in luminance value that can be perceived at a specific luminance level. A more detailed description can be found in "DICOM/NEMA supplement 28 greyscale standard display function", published by National Electrical Manufacturers Association in 1998.

A display system that is perfectly calibrated based on the DICOM greyscale standard display function will translate its P-values 104 into luminance values (cd/m$^2$) 112 that are located on the greyscale standard display function (GSDF) and there will be an equal distance in luminance JND-indices between the individual luminance values 112 corresponding with P-values 104. This means that the display system will be perceptually linear: equal differences in P-values 104 will result in the same level of perceptibility at all digital driving-levels 108. In practice the calibration will not be perfect because, typically, only a discrete number of output luminance values (for instance 1024 specific greyscales) are available on the display system. Deviations from the exact GSDF, e.g. up to 10%, are typically considered to be acceptable.

Currently the above steps are done in most cases with quantitative methods by using a measurement device. In that case the accuracy of the GSDF Conformance Check result depends on all kinds of factors like deficiencies of the different devices used. This is not important in this context; running a calibration sequence on a stable, perfectly performing display by using a perfect measurement device, will result in a nearly 100% match on the GSDF (there still is a quantisation error present and also some instability over time, temperature, . . . ). On the other hand, solutions are known to reach the DICOM GSDF without using a measurement device, but by using a visual procedure.

Known calibration tools include visual test patterns and a handheld luminance meter (sometimes referred to as a "puck") or a built-in sensor, to measure the conformance to the DICOM standard. These can provide the data to generate a custom LUT correction for DICOM Grayscale Display Function compliance. It is known to provide calibration software, such as the CFS™ (Calibration Feedback System) obtainable from Image Systems Corporation, Minnetonka, Minn., USA, to schedule when a conformance check occurs, and to generate a new DICOM correction LUT if needed. A log of tests and activity can provide a verifiable record of compliance testing, and reduce the need for technicians to take manual measurements.

Both CRT-based and LCD-based display monitors have been successfully used in medical imaging applications. From a calibration standpoint, a LCD-based display is typically more stable when viewed on-axis than a CRT-based display. A CRT can have variations from the electron gun, phosphor, and power supply that will disturb brightness settings and calibration. The LCD's primary source of variation is the backlight, although temperature, ambient lighting changes, and shock/vibration will also have effects. The characteristic curve of an un-calibrated LCD is poor in the sense of DICOM conformance, especially in the low-level grey shade regions. It is known to implement an initial DICOM correction (typically done via a Look-Up Table or LUT), before utilizing the display for diagnosis, and then make periodic measurements to ensure that the calibration correction is still accurate. Liability concerns mean that institutions need to show that they have properly implemented calibration into their medical imaging process. This involves the documentation of objective evidence that the viewing stations have been properly calibrated.

However, a major disadvantage of LCD monitors is that their behaviour (both as described with luminance and colour point) changes significantly when viewed off-axis. Several solutions exist to solve this problem. A first possible solution is to add compensation foils to the optical stack of the LCD. These compensation foils have shown to significantly improve the viewing angle behaviour of twisted nematic, VA (vertical alignment) and IPS (in-plane switching) LCDs. However, LCDs with compensation foils still show an undesirable off-axis viewing behaviour especially for particular critical applications such as medical imaging.

A second possible solution is adding a head-tracking system to the display. This head tracking system determines the position of the user and therefore the current viewing angle under which the user looks at the display. Once the viewing angle is known then it is easy to adapt the transfer curve (luminance and or colour) of the display to compensate for the off-axis viewing behaviour of the display. Such a technique is described for instance in the conference proceedings of SID 2004: "Adaptive Display Color Correction based on real-time Viewing Angle Estimation" by Baoxin Li et al. It is however a disadvantage of this technique that expensive extra hardware is required (a head-tracking system). Another disadvantage of this technique is that still the display behaviour is only correct for one particular angle and therefore the accuracy of the head tracking system determines the display performance. Moreover, in case of multiple viewers therefore this is not a suitable solution as the display behaviour can in general only be set correctly for one user.

A third possible solution to overcome the poor viewing-angle behaviour, of LCD is described in the conference proceedings of SID 2002: "Low-cost Method to Improve Viewing-Angle Characteristics of Twisted-Nematic Mode Liquid-Crystal Displays" by S. L. Wright et al. This solution uses a dithering technique to obtain better off-axis image quality. This technique is based on the idea of replacing grey levels with poor off-axis image quality by a combination of two or more grey levels with better off-axis image quality. The combination of those two or more grey levels results in (approximately) the same luminance value and/or colour point as the original grey level. A major disadvantage of this technique is that the effective resolution of the display is seriously decreased. Indeed: if a 2×2 dither block is used then the effective resolution is only one fourth of the original resolution. In case of LCDs with special pixel structure like monochrome medical LCDs having three grey sub pixels one could avoid this loss of resolution. In this situation it is possible to create a "3×1" dither block consisting of the three sub pixels of one LCD pixel. However, in case of normal pixel structures and especially with colour LCDs this loss of resolution cannot be overcome. An additional disadvantage of the technique described by S. L. Wright is that extra high-frequency noise is added in the image. Indeed: one grey level is replaced by multiple grey levels with possibly large differences between them. In the NPS (noise power spectrum) of the display this effect will be visible as higher noise power near to the nyquist frequency of the display. For some applications like medical imaging this higher noise power is unacceptable.

SUMMARY OF THE INVENTION

An object of the invention is to provide improved displays and especially provide displays featuring a better off-axis image quality in luminance behaviour and/or colour point behaviour. It is a further object of the present invention to overcome the disadvantages of existing calibration methods.

According to a first aspect the invention provides a new method to calibrate a monochrome or a colour display system in such a way that the display system is conforming to a predefined standard for a much wider range of parameters, e.g. a much wider range of viewing angles, compared to traditional calibration methods. A display standard is a set of luminances and/or colour points to be achieved by the display system for conformance to the display standard. The present invention relates to display systems which do not, per se and without calibration, reach the values of the display standard over the whole of their driving levels, e.g. for a parameter range such as a range of viewing angles.

Furthermore the invention does not necessarily require any additional hardware such as head tracking technology, also no information about the present viewing angle is needed, the present invention does not reduce the effective resolution of the display and the invention provides better image quality for a broad range of viewing angles at the same time. To achieve these goals a novel method is disclosed to calibrate the calibration curves (luminance and/or colour point) of the display system. Up to today, everyone always made every possible effort to use a photometer (external or built-in) with very narrow acceptance angle to calibrate the display. There are several reasons to use narrow-angle photometers for calibration. Regulations such as MPM Task Group 18 and DICOM GSDF recommend photometers with narrow acceptance angle. Also using such a narrow-angle photometer results in measurements that are much better reproducible and render consistent measurement results. This is because for small viewing angles (a few degrees) the behaviour of the display usually is rather consistent and similar. For larger angles however there are typically large distortions in viewing angle behaviour. A photometer with large acceptance angle will also capture those distortions and will therefore be more sensitive to angle positioning compared to a narrow angle photometer. A third reason to use small-acceptance angle photometers is that displays are viewed on-axis most of the time and therefore only the light coming out of the display on-axis is considered to be relevant. According to the present invention a collection of viewing angles will be defined that are considered relevant. In other words: a list of viewing angles is selected for which we want the display to conform to a predefined display standard (luminance and/or colour point). An example could be that we want a medical display system to be compliant to the DICOM GSDF and this in a viewing cone of 20° (so any viewing angle as long as the angle between viewing angle and normal to the display is less or equal than 20°). It is to be noted that other collections are possible such as but not limited to (described shapes in polar viewing diagram defined by angles phi and theta): elliptical and circular shapes with the centre of mass being at angle (0,0) or at any other point, any convex or concave shape, collections that consist of two or more not connected areas in the viewing angle diagram. It is to be noted that this list of viewing angles can be selected once (fixed) or can be made dependent on the user, the type of application that is running, the mechanical setup of the display system (single display, two displays, type of chair, type of desk, room characteristics, . . . ) in which case the selection of the right collection of angles can be done automatically or manually. Once the list of angles is available a novel calibration algorithm will calculate the best calibration curves for the display in order to be conform to the predefined display standard for that selected collection of angles. The problem to be solved is an optimisation problem that uses information on the behaviour of the display and this for multiple viewing angles. The parameters to be optimised are the values of the calibration curves. The number to be optimised, e.g. maximized, is the degree of conformance to the predefined display standard or standards and this for the viewing angles in the collection of angles that was selected. The degree of conformance to a display standard can be any metric; the exact metric used is not a limitation of the present invention. Some examples are the "measures of conformance" as described in "Digital Imaging and Communications in Medicine (DICOM), supplement 28, Greyscale Standard Display Function". The solution of the optimisation problem is the calibration curves for that display that give the best degree of conformance to a predefined standard or standards and this for the specific angles selection in the collection of angles. It can be seen that the present invention overcomes all problem of existing methods. No extra hardware is needed since the result of the optimisation problem is just one (for instance in case of monochrome displays) or more calibration curves (for instance in case of colour displays, one curve for each of R, G, B) that are loaded into the display or graphical board. The disclosed method also does not result in any decrease of effective resolution. Moreover, the disclosed method results in better off-axis conformance to a predefined display standard or standards and this for multiple angles at the same time (more specifically for the angles that were selected in the collection of angles).

According to a second aspect the invention provides methods for selection of the collection of angles for which the display needs to be compliant with the target standard display function and the selection of the best calibration curves(s) for which the display is compliant with the target display function for the specific setup and user situation. One could select the set of angles based on the mechanical setup of the display system. With medical display systems one typically uses more than one display. This means that in normal viewing situations each monitor is looked at from a specific angle. In the example of two monitors the user could be sitting in front of the monitors so that the user looks at the left monitor under an angle of (horizontal angle, vertical angle): (−10°, +5°) and at the right monitor under an angle of (+10°, +5°). Of course all kinds of variations are possible with tilted monitors, more than two monitors, monitors of different sizes, monitors put at different heights, . . . One could select the collection of angles (for each monitor) based on the characteristics of this mechanical setup such that in typical using situation the collection of angles is optimally corresponding to the actual (or most likely) viewing angle and this for each monitor. By using presets for typical mechanical setup it would be easy for the user or the installer of the display system to select in one operation the optimal selection of angles for all monitors at once. The presets can describe the complete collection of monitors, for example "two monitor system radiology reading room" or could still describe individual monitors such as for example "left monitor from two monitor system radiology reading room". One could also define presets not only based on the mechanical setup but also based on individual users. It is possible that there is a difference in viewing angles depending on the specific user. For example: one person can be much taller than another person, or can use other chairs, or can be sitting in another preferred position in front of the displays, . . . It is also possible to create presets based on the actual application (type of task or software package) for which the display system is being used. For example: for some tasks it could be that only one monitor displays information or is required. Of course this will result in other typical viewing angles and therefore another preset is useful. Another basis for creating presets could be the number of users using the display system at the same time. In a single user situation the viewing angles at which the user looks at the display(s) will differ from a situation where multiple users look at the display(s). For instance in a teaching situation or a situation where multiple radiologists discuss one case that is being displayed on one or more monitors, the optimal collection of angles used to optimise the display conformance will be different from the single user situation. In the most general case: any user could create a preset (collection of angles for which the display(s) should be conform to one or more selected standards) for the specific desired situation. This preset then can be selected manually or automatically (triggered by an event/situation or combination of events and/or situations).

BRIEF DESCRIPTION OF THE DRAWINGS

FIG. 3*a* shows the "target luminance curve" of the DICOM GSDF standard together with the +10% and −10% tolerance curves. FIG. 3*b* shows dL/L in function of JND index. FIG. 3*c* shows the number of JNDs per step in function of JND index (or p-value).

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. Where the term "comprising" is used in the present description and claims, it does not exclude other elements or steps.

As an example a possible implementation of the present invention for a monochrome medical display is described and this for conformance to the DICOM GSDF standard. However, the invention is equally applicable to colour display systems (such as LCDs, OLEDs, PDPs, projection displays . . . ) and for compliance to any other standard or standards.

Figure 10:
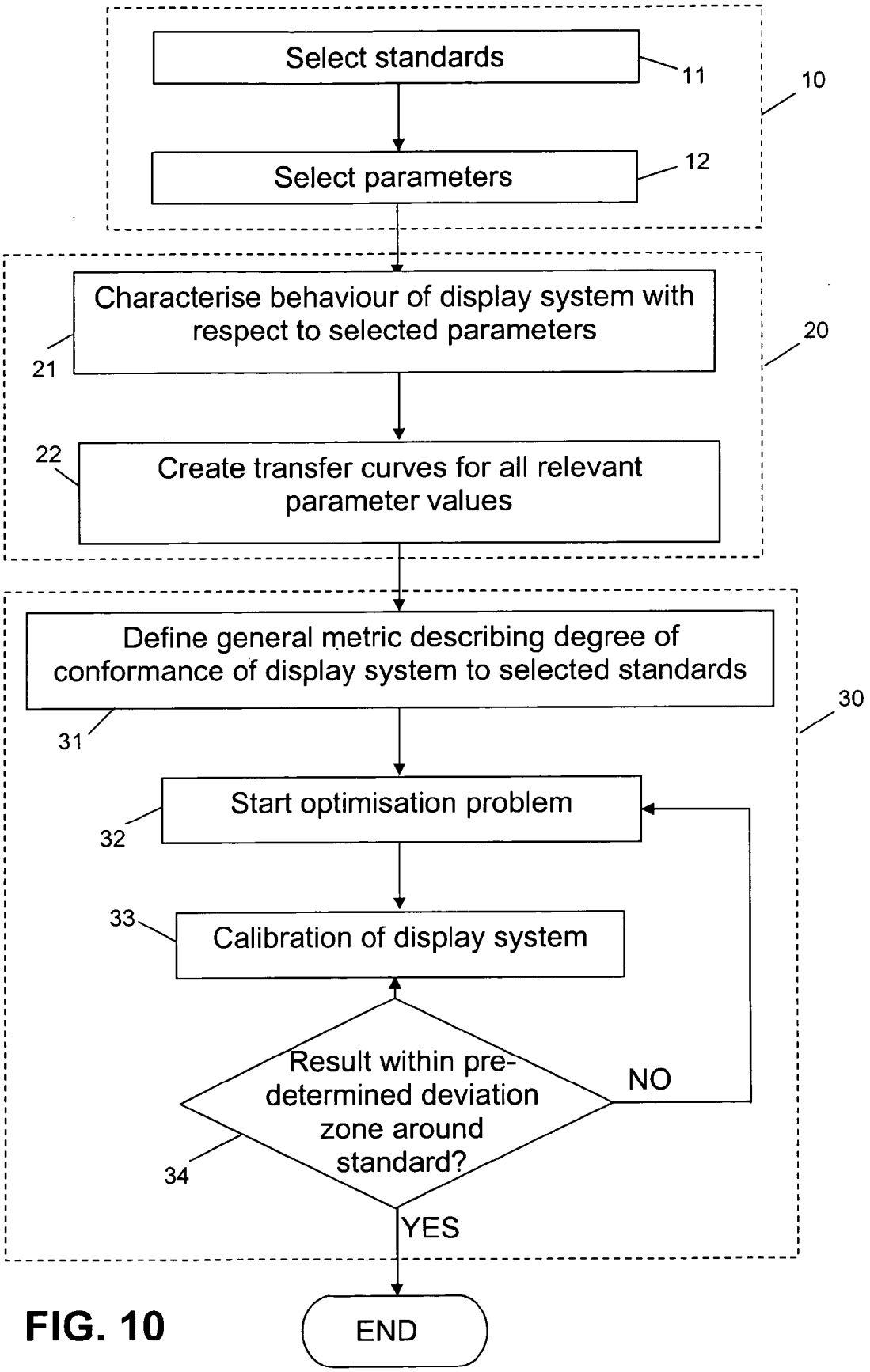
FIG. 10 is a flow chart illustrating the method according to embodiments of the present invention.

The method according to embodiments of the invention is illustrated in the flow chart in FIG. 10.

Figure 1:
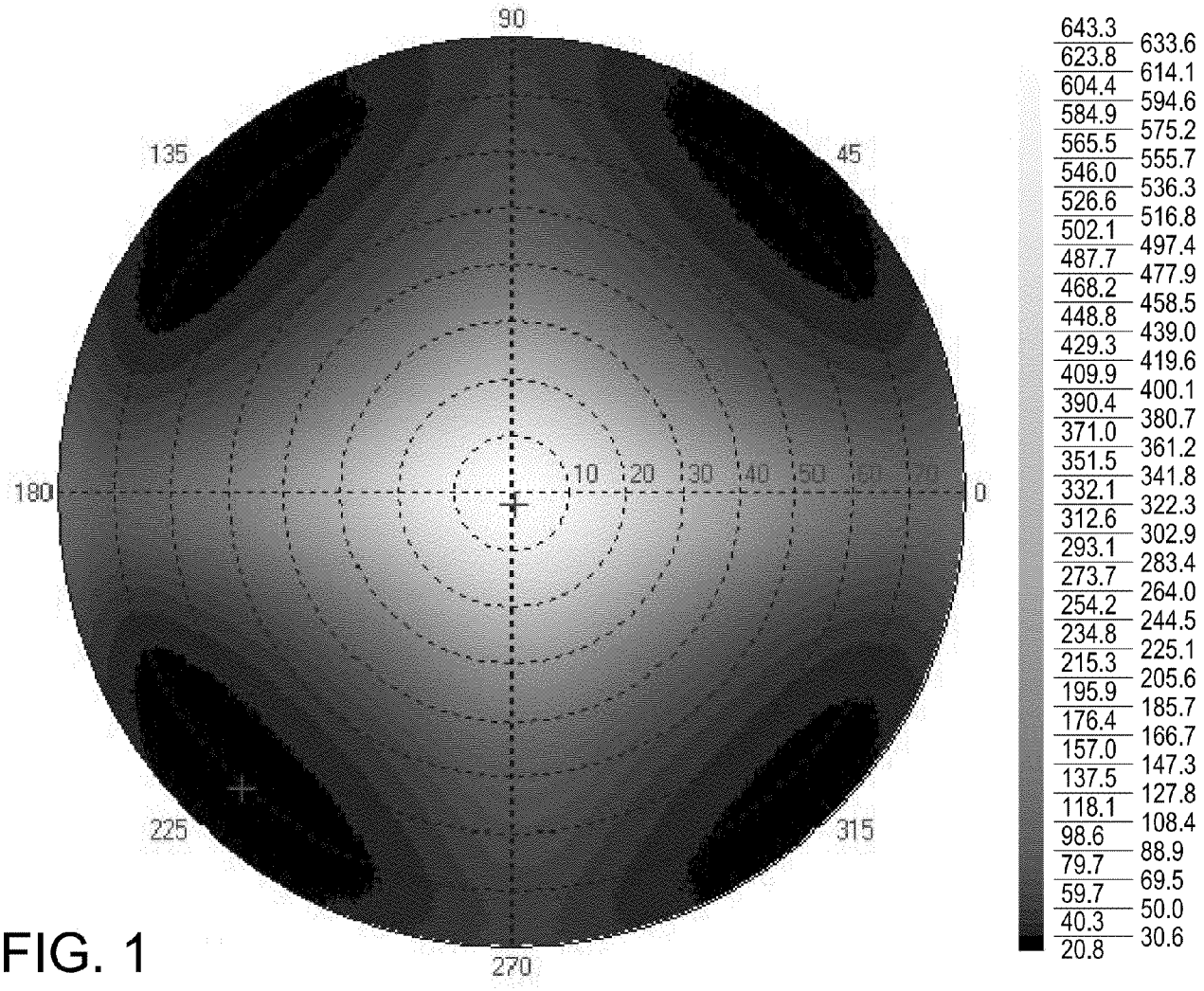
FIG. 1 illustrates the viewing angle behaviour of a monochrome medical LCD for one video level.

In a first phase 10, in a first phase 11, the standard or standards have to be selected which the display system needs to be compliant to. Also, in step 12, the parameters need to be selected for which the display system needs to be compliant to those standards. In this example the DICOM GSDF standard for medical displays is selected in step 11. As parameter, in step 12, the viewing angle is chosen, and as selection of angles for which compliance is desired, a viewing cone of 20° is selected. This means that in any direction, as long as the user looks at the display under an angle lower than (or equal to) 20°, the display system will still be compliant to the standard. In FIG. 1 this selected range of angles would be represented as a circle with radius "20" and with its centre at the centre point of FIG. 1. It is to be noted that it is perfectly possible to select more than one standard for which compliance is desired. Also this process of selecting a collection of angles and standards can be done manually or automatically. The selection process can be influenced by external factors such as but not limited to: actual person using the system, environmental conditions, intended task of the display system, exact mechanical setup of the display system, a preference user profile, . . .

In a second phase 20 the behaviour of the monochrome medical LCD (Barco Coronis 5MP) with respect to the selected parameter, e.g. viewing angle, is characterized in step 21. In the example described the viewing angle behaviour was determined using two methods. A first method was by means of the EZContrast measurement device of the company Eldim, Hérouville Saint Clair, France. With this device the viewing angle behaviour was measured for all grey levels of the display system. For each measured video level a plot as in FIG. 1 is generated together with the actual measurement values (cd/m$^2$ and (x,y)-colour coordinates) describing the display behaviour in function of viewing angle. Since this example is about a monochrome display system only luminance values in function of viewing angle are considered to be interesting. Instead of measuring all 1024 grey levels of the display system it is of course also possible to measure some well selected video levels and to use interpolation to generate the data for the video levels in between the measured levels. In this way the measurement time is reduced. A second method to characterize the viewing angle behaviour of the display system is by means of a Minolta CA-210 LCD Colour Analyzer of the company Konica Minolta. This device can do a measurement of luminance value (cd/m$^2$) and colour point ((x,y)-coordinates) but only for one angle at the time. Therefore a mechanical table was used that can automatically and accurately place the probe of the CA-210 as needed to measure a particular viewing angle. Of course other methods are possible to come to the same characterization data of the display. The present invention is not limited to the two given examples. It is to be noted that also for the viewing angles it is possible to only measure a limited number of viewing angles and use interpolation to generate the data for viewing angles that were not measured. Again this will reduce measurement time.

Figure 2A:
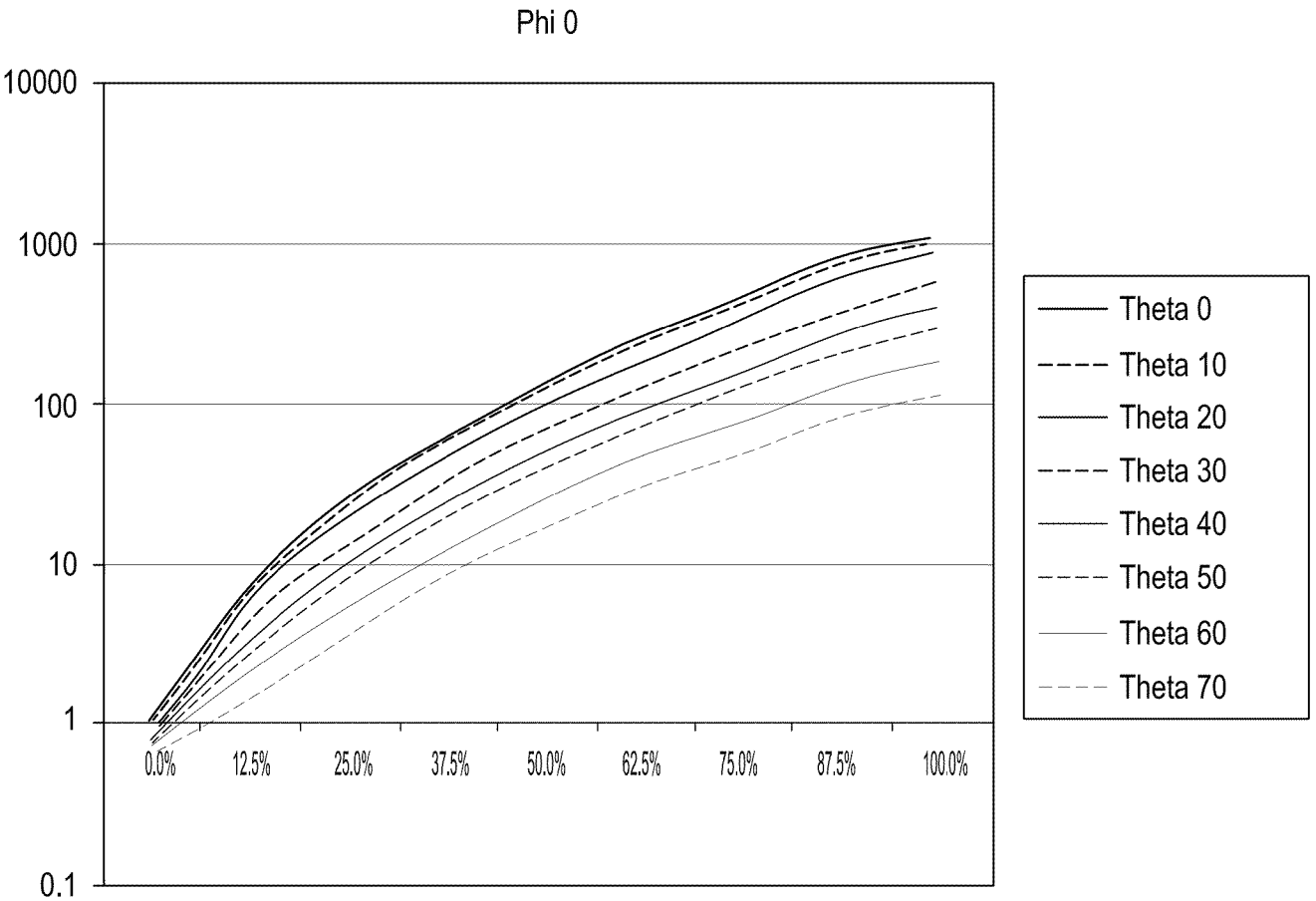
FIG. 2*a*, FIG. 2*b* and FIG. 2*c* respectively illustrate transfer curves (luminance in function of driving level) viewing angles 0°, 45° and 90°. In the above plots Phi corresponds to the angle in the plane of the display (see FIG. 1, values 0, 45, 90) and Theta corresponds to the angle between the viewing direction and the normal on the display surface (see FIG. 1, values 0, 10, 20, 30, . . . ).
Figure 2B:
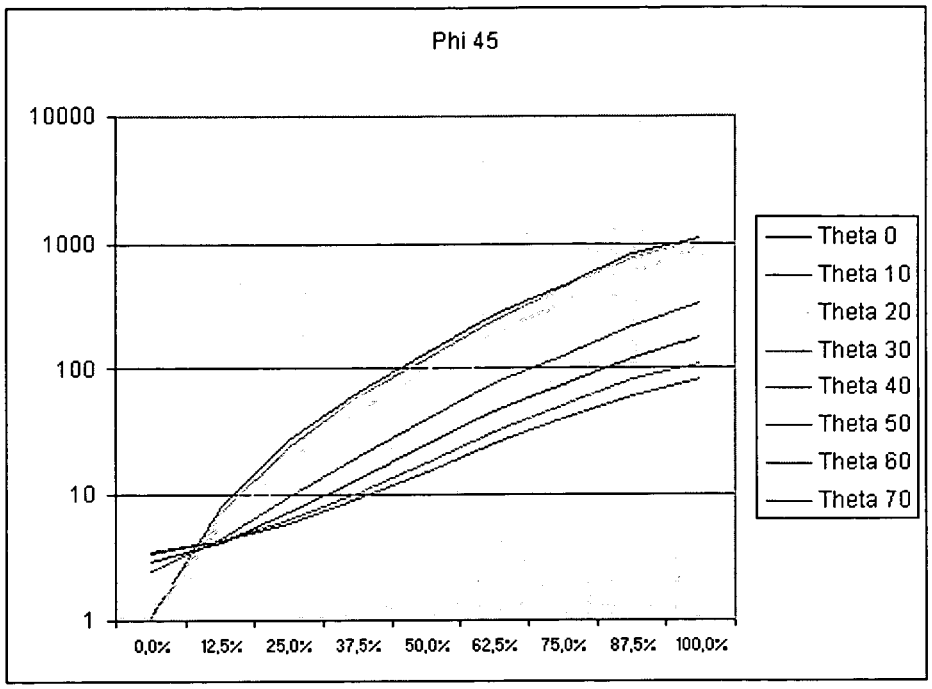
Figure 2C:
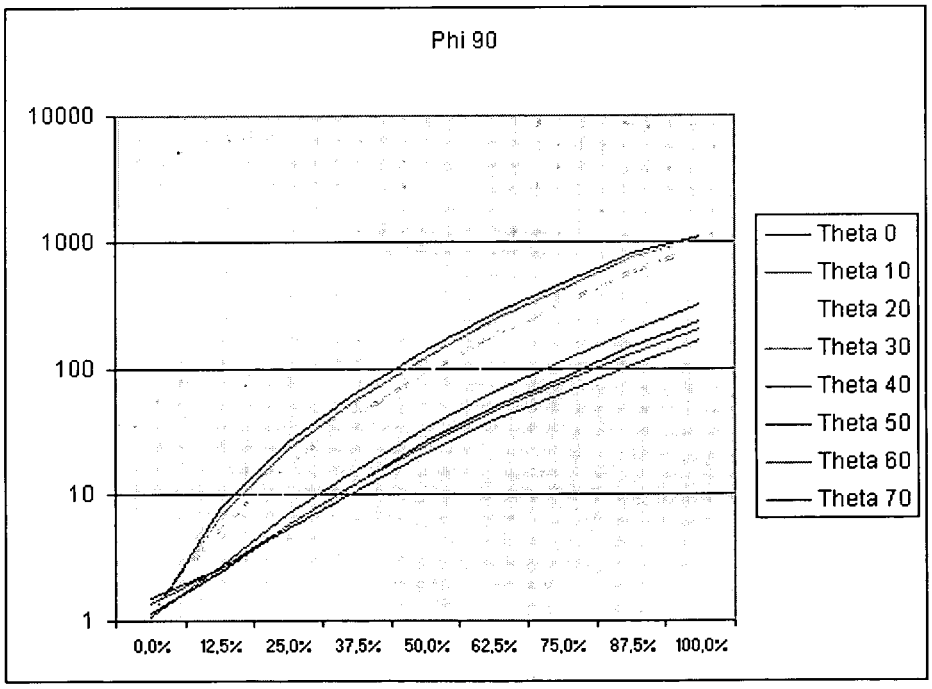

Once the luminance (and colour point) behaviour is known for every relevant parameter value, e.g. every relevant viewing angle, and video level, transfer curves describing luminance in function of driving level are created for the display system in step 22, and this for all relevant parameter values, e.g. viewing angles. Examples are given in FIGS. 2*a*, 2*b* and 2*c*. It is to be noted that for a display system having a backlight it is possible to generate (calculate) the viewing angle characteristics and therefore transfer curves for a new backlight value based on measurement data of a previously measured backlight value. This is because in principle changing the backlight value can be treated as applying a gain (multiplication) factor to the viewing angle data and transfer curves. This principle also holds for instance for reflective display systems if the ambient light changes or for trans-reflective display systems if either the ambient light changes, or the backlight changes, or a combination of both. It is to be noted that in the situation of colour displays there can be different gain factors for the different colour transfer curves if also the spectrum of the ambient light or backlight changes. It is to be noted that in case of colour displays one could create three transfer curves describing luminance value (cd/m$^2$) of each of the colour channels in function of drive level and this for relevant viewing angles. Alternatively one could create for each colour channel a transfer curve indicating luminance (cd/m$^2$) in function of drive level but also colour coordinate (x,y) in function of drive level and this for the relevant viewing angles. The general idea is that those transfer curves need to be created that are required to calculate the compliance of the display system to the selected standard(s).

It is to be noted that the process of characterizing the parameter dependence behaviour, e.g. viewing angle behaviour, of the display system can be done once (during manufacturing of the display for instance) or continuously (possibly real-time and user transparent) in the field or periodically at fixed times or at request of the user (recalibration).

Figure 3A:
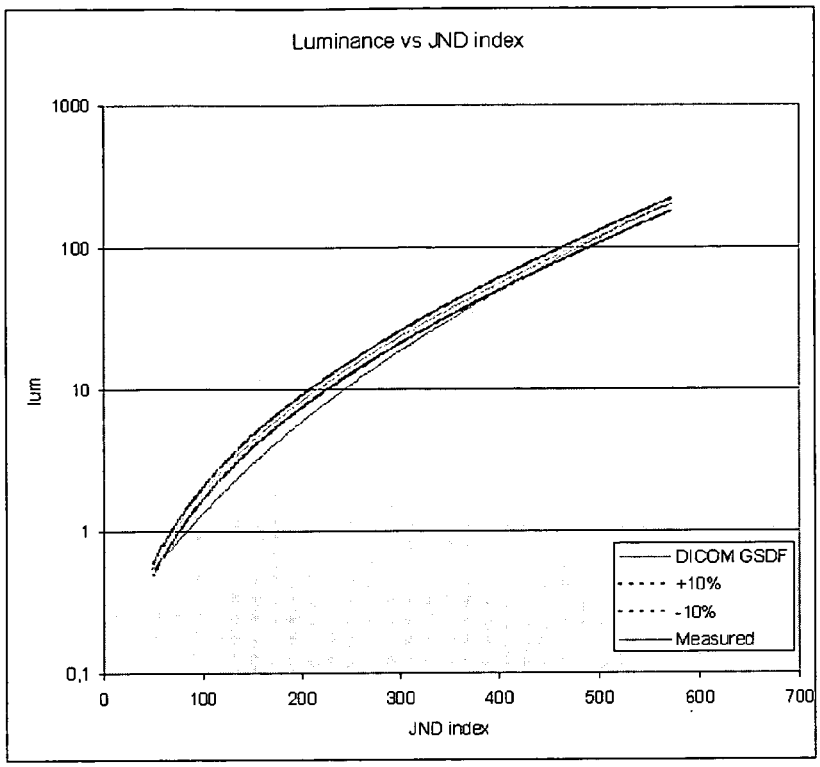
FIG. 3*a*, FIG. 3*b* and FIG. 3*c* show examples of metrics for the DICOM GSDF standard.
Figure 3B:
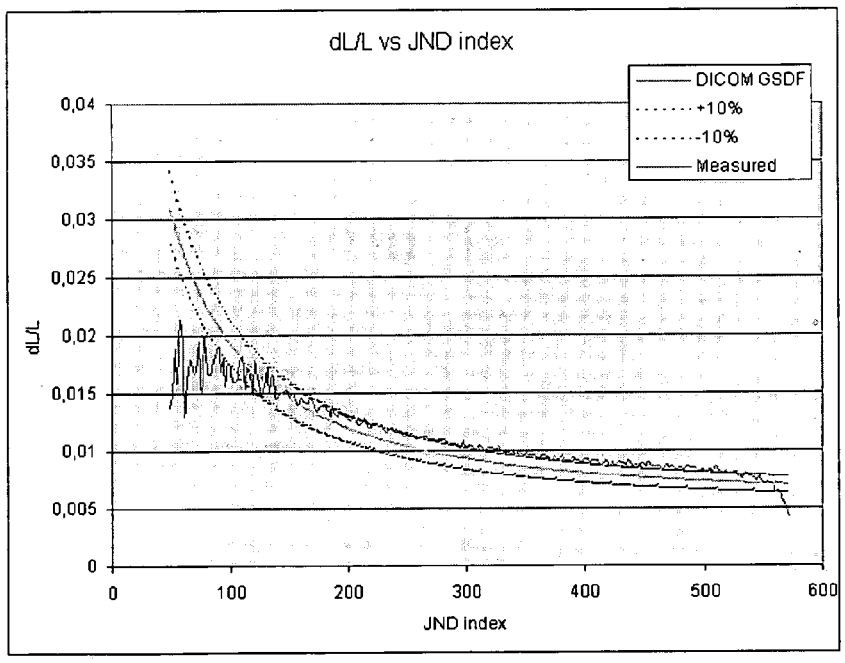
Figure 3C:
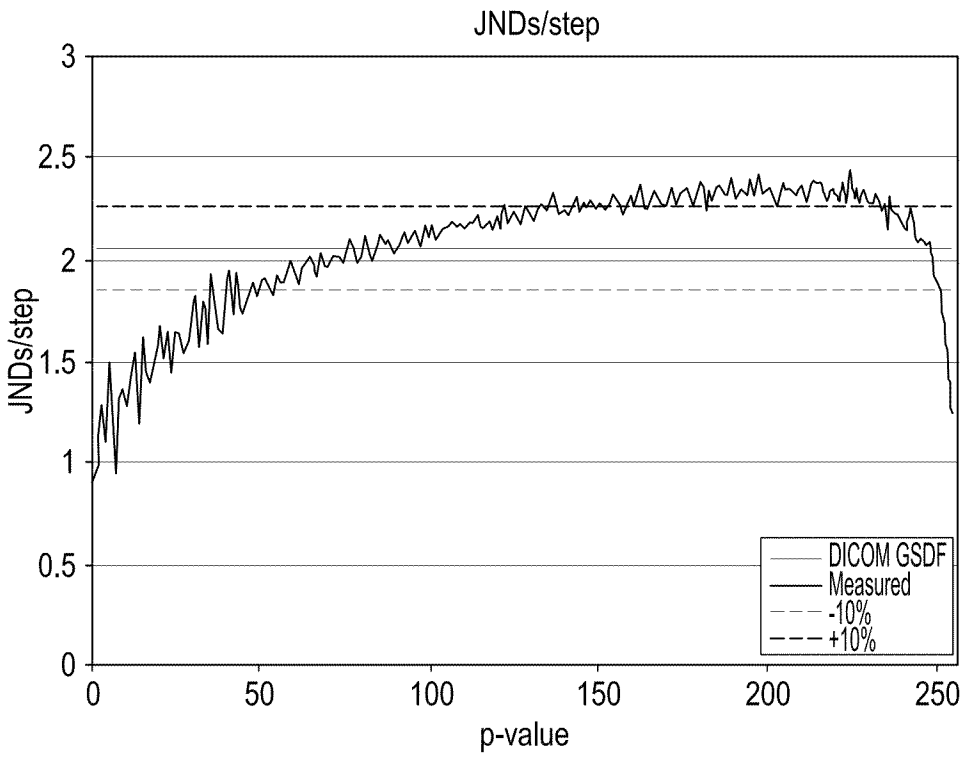

Once the standards and parameters, e.g. viewing angles, for which compliance is desired are selected, and also the characterization data of the display is available, then the actual calculation of calibration parameters will take place in a third phase 30. This calculation of the optimal calibration parameters, e.g. calibration table or calibration tables, can be implemented or described as a maximization problem. To do this it is necessary that in step 31 a metric is or metrics are defined that describe the degree of conformance of the display system to the selected standard(s). In some situation such metrics exist because they are part of the standard or because there is a generally accepted method of determining whether a display system is compliant or not. In other situations a metric will have to be created. The only requirement for such a metric is that it should be possible to compare if one display system is more compliant to the display standard(s) than another display system. In FIGS. 3*a*, 3*b* and 3*c* an example of a metric is given for the DICOM GSDF standard. Plot 3*a* shows the "target luminance curve" of the DICOM GSDF standard together with the +10% and −10% tolerance curves. A generally accepted opinion is that as long as the actual transfer curve of the display system is in between the +10% and −10% curves then the display system is calibrated correctly. Plot 3*a* also shows an example of an actual measured transfer curve. It can be seen from plot 3*a* that this measured curve is not in between the tolerance curves for all driving levels (it is to be noted that the x-axis "JND index" is directly related to driving levels) and therefore this display system would be not compliant to DICOM GSDF. In order to change this "yes/no" system to a useful metric one could for example define a metric describing the accumulated (total) deviation from the DICOM GSDF target luminance curve. As an example this could be the sum of the relative (in percent) deviation of the measured transfer curve compared to the target transfer curve and this summed over all (relevant) video levels. In this way it is possible to directly compare multiple display systems and determine which one is "more compliant" than another display system. In this example a lower metric value means better conformance. It is also possible to define metrics where higher metric values mean better conformance. It is to be noted that all types of variation metrics are possible: one could use absolute deviation instead of relative deviation, also one could assign weights (weighted sum) to video levels (indicating that some luminance ranges are more important than other ones), one could also insert non-linear functions (for example: as long as the relative deviation is less than 10% then the function value is zero, otherwise it is the relative deviation squared [or for example a very large value so that this solution will never be selected]). The generally accepted conformance test for DICOM GSDF consists of three parts. The first part (target luminance curve conformance) has already been described with regard to FIG. 3*a*; the other two parts are shown in plots 3*b* and 3*c*. Plot 3*b* describes dL/L in function of JND index. For a detailed description there is referred to the DICOM Part 14 for the Grayscale Standard Display Function (GSDF). Also for this plot a metric can be created describing the degree of conformance of the display system to this part of the standard. The same holds for the third part describing the number of JNDs per step in function of JND index (or p-value). Based on those three parts one can create a general metric of compliance to DICOM GSDF. The combination of the three metric values (corresponding to the three parts of the standard) can be done by any linear or non-linear function. An example could be just summing the values, yet another example is assigning weights to the different parts.

Once such a general metric is created which enables a user to directly compare the degree of conformance to a standard (or standards) between different display systems, the optimisation problem can be started (which can be a minimization or maximization problem depending on whether a higher metric value corresponds to poor conformance or better conformance), step 32. This optimisation problem can be described as follows:

$$\text{calibration_LUTs} = \arg\left[\max_C \left\{ \sum_{collection_of_parameters_a} m(C, a) * w(a) \right\}\right]$$

where

"C" represents a specific (set of) display parameters, such as e.g. calibration parameter(s), e.g. lookup-table(s), of the display system;

"m" represents the function describing the metric of compliance to the display standard(s); "m" preferably is a cost function to be minimised, for example deviation from an enforced standard;

"w" represents a function assigning weights to the individual parameters, e.g. viewing angles;

"a" represents a specific parameter value, e.g. a specific viewing angle;

"calibration_LUTs" represents the solution of the minimization/maximization problem and therefore the optimal calibration parameters/lookup-tables;

$\max_c$ represents the maximum over all possible display parameters, such as e.g. calibration tables or parameters "C".

Depending on the way m is constructed, the optimisation problem can be a minimisation problem, defined by $$\text{calibration_LUTs} = \arg\left[\min_C \left\{ \sum_{collection_of_parameters_a} m(C, a) * w(a) \right\}\right],$$

wherein all variables are as defined above.

The result of the optimisation problem, i.e. maximisation or minimisation problem, results in a calibration of the display system under reference, as in step 33, leading to a better result with regard to conformance with the enforced standard, i.e. the behaviour of the display system better conforms the enforced standard than the uncalibrated display system. Optimisation may be finished, step 34, when the result of the optimisation problem falls within a pre-determined deviation zone around the enforced standard, e.g. within a 10% deviation from the enforced standard, and this for all relevant values in the parameter range or in the ranges of parameters.

It is to be noted that the function "w(a)" can have both positive and negative values. A negative value would have the meaning that no compliance to the standard is desired for those parameter values, e.g. viewing angles. Such a situation is for instance possible in case the user is not wanted to look at the display from large angles. Then negative w(a) values could be assigned for those angles, therefore the display will certainly be not compliant to the standard for those angles, and therefore the image will most likely look bad for those viewing angles and the user will understand by himself that something is wrong and change the viewing angle.

To summarize: the solution of the minimization (or maximization) problem will be that set of calibration parameters that will result in the best overall compliance to the selected displays standard(s) and this for the collection of parameters, e.g. viewing angles, that was selected. It is to be noted that as an extension the present invention does not need to be restricted to "calibration parameters". Indeed: one could also optimise over all kinds of display parameters (denoted as 'C') such as but not limited to calibration tables, backlight settings (luminance, colour temperature, . . . ), all kinds of settings of the display, settings of the graphical board, settings of the host OS, settings of the application running on that host OS, settings of the environment (ambient light value, ambient or display temperature, humidity, colour temperature of the ambient light, settings/preferences of the mechanical setup including display system, . . . ), . . . Also the present invention does not need to be restricted to "viewing angles" as parameter. Indeed, one could apply the summation over at least one parameter selected from a group comprising viewing angle, calibration tables, backlight settings (luminance, colour temperature, ambient light value, ambient or display temperature, . . . ), all kinds of settings of the display, settings of the graphical board, settings of the host OS, settings of the application running on that host OS, settings of the environment (ambient light value, colour temperature of the ambient light, settings/preferences of the mechanical setup including display system, . . . ), specific users or groups of users, specific task or applications for which the display system will/can be used . . . Optimisation can be done over more than one parameter. The extension of the present invention to, for instance, ambient light strength can be interpreted as calibrating the display in such a way that the compliance of the display system to specific selected standard(s) is as much tolerant as possible to changes in ambient light conditions. Similarly if one just takes viewing angle into account then the present invention can be interpreted as calibrating the display in such a way so that the compliance of the display system to specific selected standard(s) is as much tolerant as possible to changes in viewing angle (possibly with some restrictions on specific viewing angles that are important for the specific application). At least two parameter values are to be taken into account, and preferably a plurality of parameter values within a range of parameter values; still more preferred all parameter values within a range of parameter values.

Figure 4A:
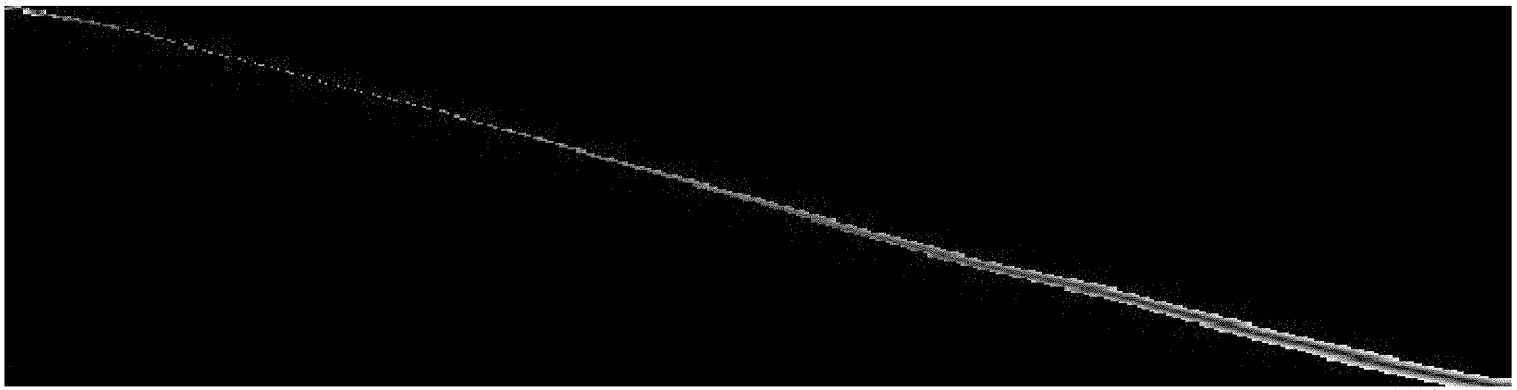
FIG. 4*a* illustrates the principle of only calculating the conformance metric for look-up table content that has a minimum compliance to the DICOM GSDF standard.
Figure 4B:
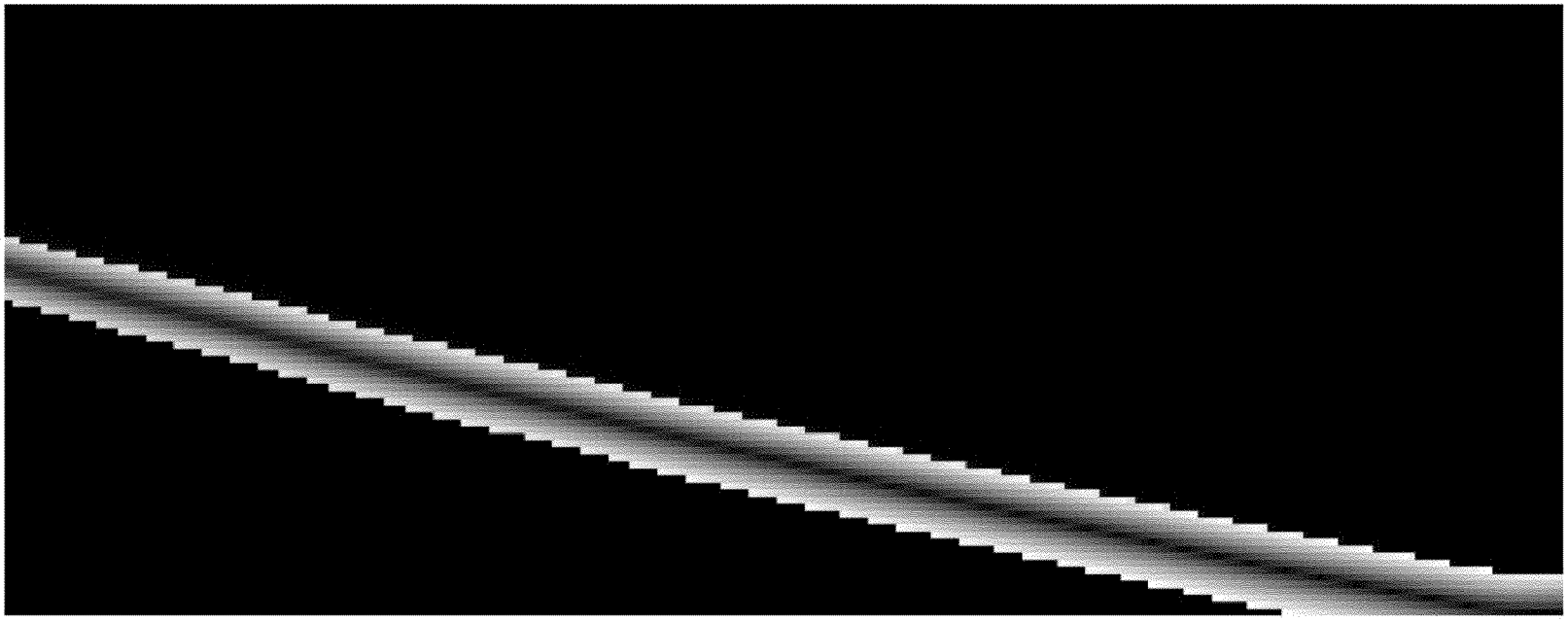
FIG. 4*b* is a detailed plot of the higher luminance values of FIG. 4*a*.

To solve the optimisation problem, one can use of course all mathematical methods that are available such as but not limited to: extensive search, random search, linear programming, Newton-Raphson methods, . . . It is to be noted that there the optimisation problem as described above could be computationally (very) expensive. As an example a more efficient method of solving the optimisation problem in case of compliance to DICOM GSDF is described here. In this case the problem is that the parameter "calibration_tables" is a lookup-table of 256 entries and each entry has 1024 possible values. So in theory to solve the optimisation problem rigorously one would have to test (1024)^256 possibilities which is a way too large number to test in reasonable time with current computing capabilities. Therefore a more efficient method is used. The method exploits the fact that some possible content of the calibration lookup-table are considered to be a solution that is "not compliant with the selected standard display function(s)". This could be described for instance by setting a threshold on the conformance metric: if the value of the conformance metric for a specific situation is lower (or higher) than a specific threshold value, then this solution is not considered anymore. More specifically: in the case of DICOM GSDF one could only consider calibration parameters, e.g. calibration lookup-tables, for which all of the entries are compliant with the first conformance metric, which is the target luminance curve. In other words: instead of testing all possible content of the calibration lookup-table, one could start with the first entry of the lookup-table and verify which possible values for that first entry will result in "minimum-compliance" to the selected display standard. Such minimum compliance could mean (in case of the DICOM GSDF for instance) that the absolute luminance value corresponding to that specific value for the first entry of the calibration lookup-table should not differ more than 10% relatively from the target luminance curve. In this way the number of possible values for the first entry of the calibration lookup-table can be reduced from 1024 to for instance 3. This immediately reduces the computation time needed to test all possible values of the calibration lookup-table by a factor of three. The same principle can be applied for the second entry of the calibration lookup-table, and the third entry, . . . and the last entry. The result is that only for those entries that are considered to have "a minimum degree of compliance to the standard that has been selected". FIG. 4*a* and FIG. 4*b* show this principle of only calculating the conformance metric for lookup-table content that has a minimum compliance to the DICOM GSDF standard. FIG. 4*b* is a detailed plot of the higher luminance values of FIG. 4*a*. The vertical axis of FIG. 4*a* and FIG. 4*b* show the 256 entries of the lookup-table while the horizontal axis represent the 1024 possible values for each entry of the lookup-table. The shade of gray in FIGS. 4*a* and 4*b* represent the degree of conformance to DICOM GSDF (in particular: the relative deviation of the absolute luminance value corresponding to this specific value for this specific entry in the calibration lookup-table compared to the absolute luminance target curve of DICOM GSDF) for a specific entry of the lookup-table. For example: supposing that if for entry 123 of the calibration lookup-table the value 128 would result in a relative distortion compared to the target luminance curve of DICOM GSDF of 6%, then the grey level value for point (123,128) would be 6%. It is to be noted that in FIG. 4*a* and FIG. 4*b* only the central band going from upper left to lower right region has minimum compliance to DICOM GSDF what concerns absolute luminance target curve (this means: the deviation for each point of the curves in this band is lower than 10% compared to DICOM GSDF target luminance curve). It is to be noted that in FIGS. 4*a* and 4*b* only a very limited number of calibration lookup-tables results into minimum compliance with DICOM GSDF. These possible calibration curves are all possible curves starting at the upper left corner of FIG. 4*a* and going to the lower right corner of FIG. 4*a*. Therefore only for those curves the other two plots will be evaluated and the computationally expensive calculation of the compliance metric will be done. It is to be noted that yet another method could be that the solution of the "minimization problem" is calculated as "any" curve that has minimum compliance to DICOM GSDF. This means: any curve that has less than 10% (or any other number) relative deviation from the luminance target curve of DICOM GSDF and that also has minimum compliance to the other two conformance metrics of DICOM GSDF. In case there are multiple solutions one could select the solution with the best conformance metric value or just select a random curve from this set if the starting point is that "conformance" is sufficient and the degree of conformance is not that important. It is to be noted that the calculation method as shown in FIGS. 4*a* and 4*b* can also be applied for the other two conformance plots of DICOM GSDF (FIGS. 3*b* and 3*c*). In this case a similar figure as in FIGS. 4*a* and 4*b* would result except for that the grey level value in this new figure would not represent the relative distortion according to the target curve of plot 3*a*, but the relative distortion compared to plot 3*b* and plot 3*c*. It is to be noted that also other functions are possible to convert plots 3*a*, 3*b* and 3*c* to plots such as 4*a* and 4*b*. The function "relative distortion" is just one possibility and is not intended to limit the present invention.

Once the optimal calibration lookup-table (or parameters in general) has been calculated then this calibration lookup-table (or parameters in general) are configured. This could mean for instance loading this calibration lookup-table into the display or in the graphical board or in the host OS or in the application running on the host OS. Configuring the display system with the optimal parameters ensures that indeed the display system will have the best possible compliance to the predefined display standard(s) and this for the parameter range (for instance viewing angles) that were selected to be relevant/important. Changes to the parameter (e.g. viewing angle) within the parameter range will not result in requiring reconfiguration. The method according to the present invention does not need to be dynamically applied with every change to a parameter value. Calibration parameters may be calculated once and for all, e.g. at the end of the manufacturing process. The optimal calibration parameters which are determined according to the present invention can be used when using the matrix display with any of the parameter values within the parameter range for which the optimal calibration parameters have been determined.

Figure 11:
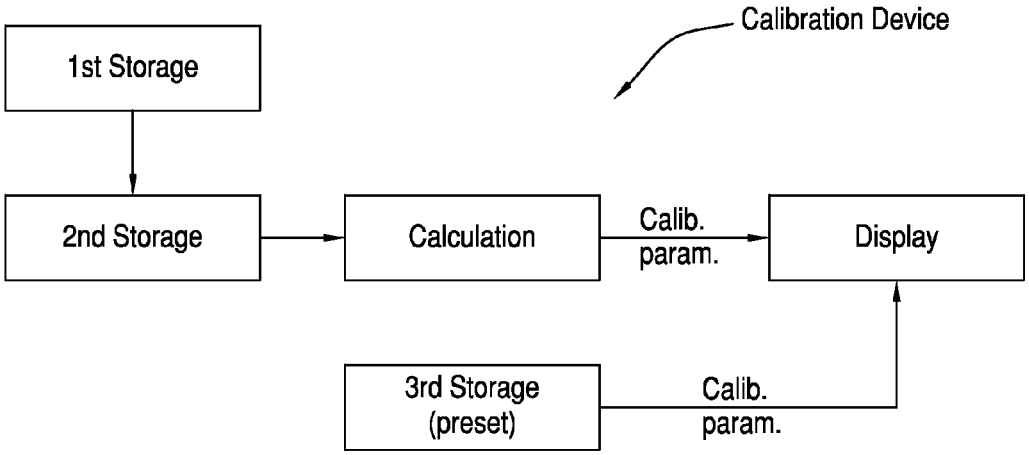
FIG. 11 is an illustration of a calibration device for calibrating a matrix display.

A calibration device for calibration the matrix display with respect to at least one enforced greyscale or colour display standard, is schematically illustrated in FIG. 11. The calibration device includes a first storage means for storing a characterization of the non-conformance in greyscale or colour values of the matrix display as a function of its drive signals with respect to a plurality of relevant values of at least a first parameter. The calibration device may further include a second storage means for storing a set of calibration parameters in function of at least the first parameter, based on the at least one enforced greyscale or colour display standard, and the characterized non-conformance in greyscale or colour values of the matrix display. The calibration device may still further include calculation means for optimising the set of calibration parameters with respect to a degree of conformance to the at least one enforced greyscale or colour display standard for all values of at least the first parameter within a relevant parameter range, thus obtaining a set of optimal calibration parameters for use with the matrix display. The calibration device may still further include a third storage means for storing pre-sets of optimal calibration parameters for pre-determined first parameter values.

Figure 5:
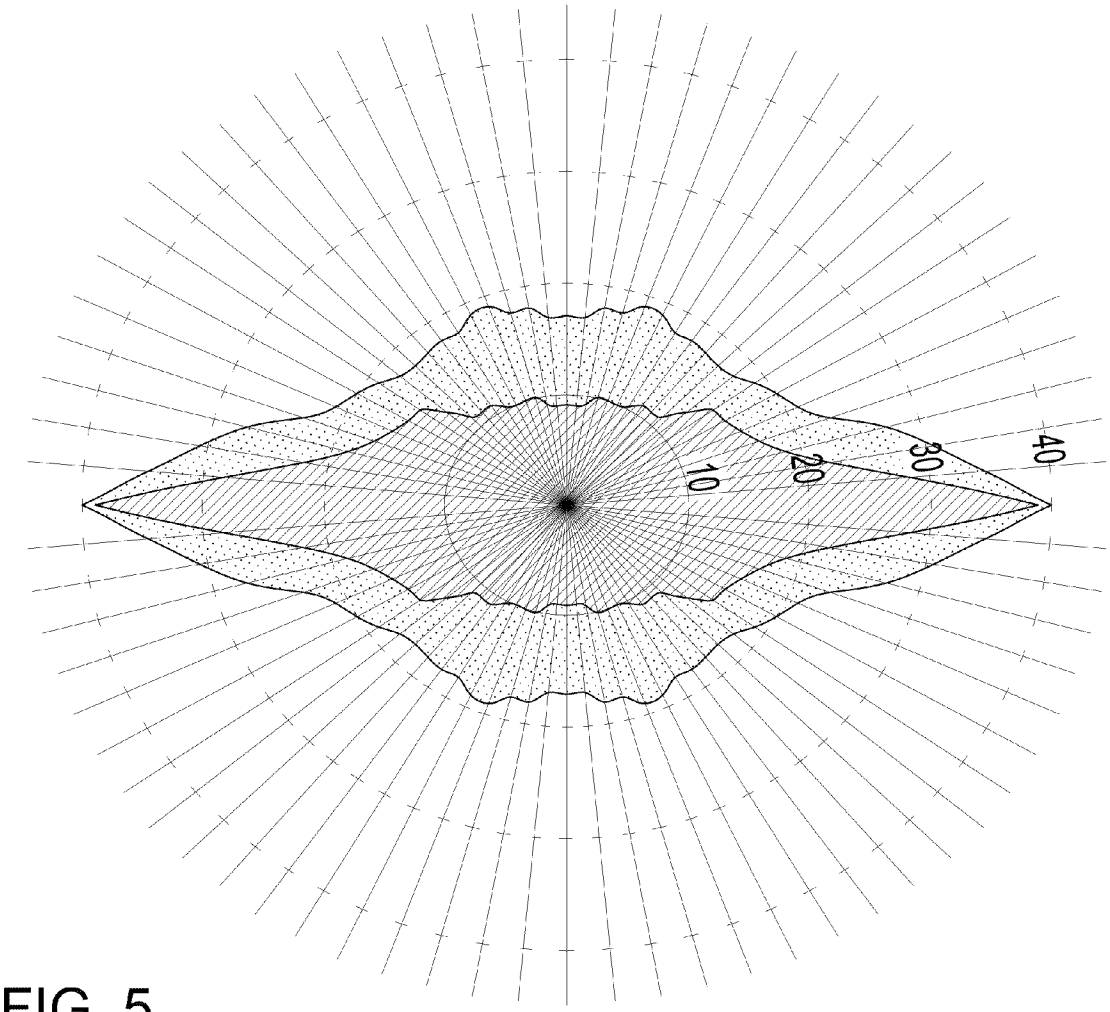
FIG. 5 shows the angles for which a particular display system is compliant to DICOM GSDF, within the 10% tolerance area, and this for traditional on-axis calibration (central region) and for the method according to the present invention (larger region).
Figure 6A:
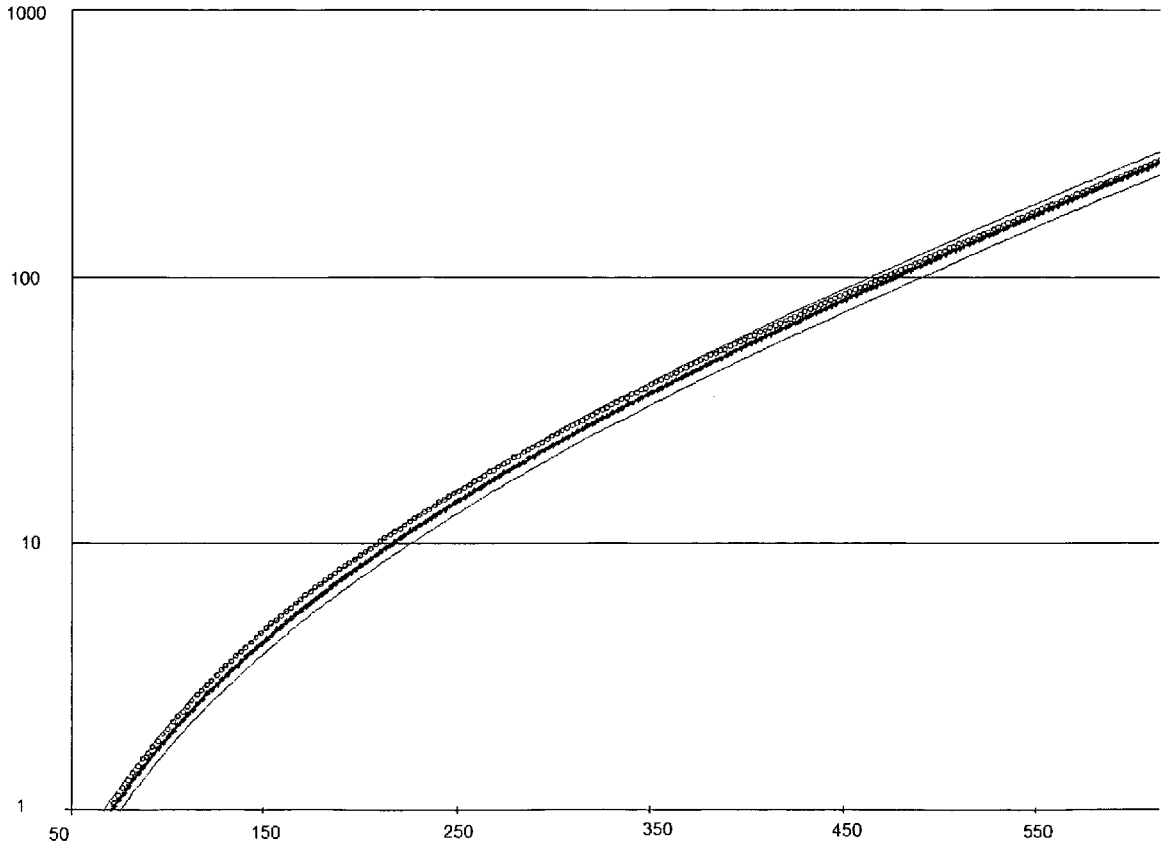
FIG. 6*a* compares the conformance of a monochrome medical display system to DICOM GSDF in case of on-axis viewing by illustrating the target luminance curve and the luminance curves for normal on-axis calibration and for calibration according to the method according to the present invention.
Figure 6B:
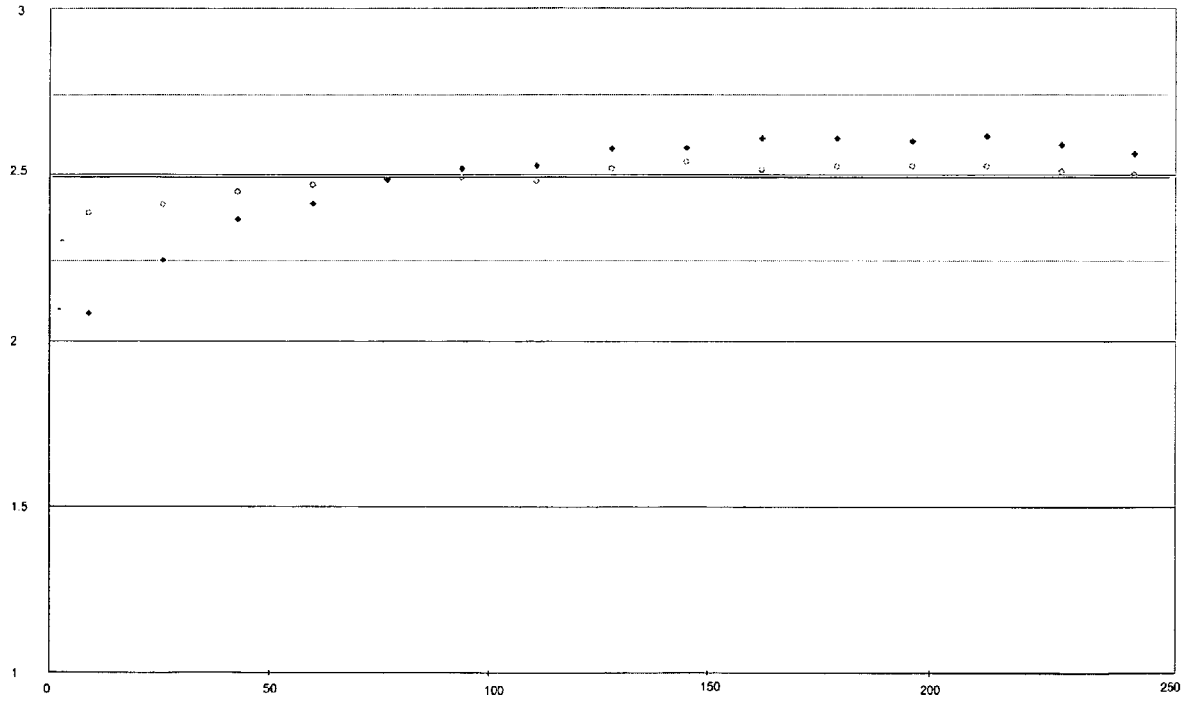
FIG. 6*b* is a detailed view of FIG. 6*a*.
Figure 6C:
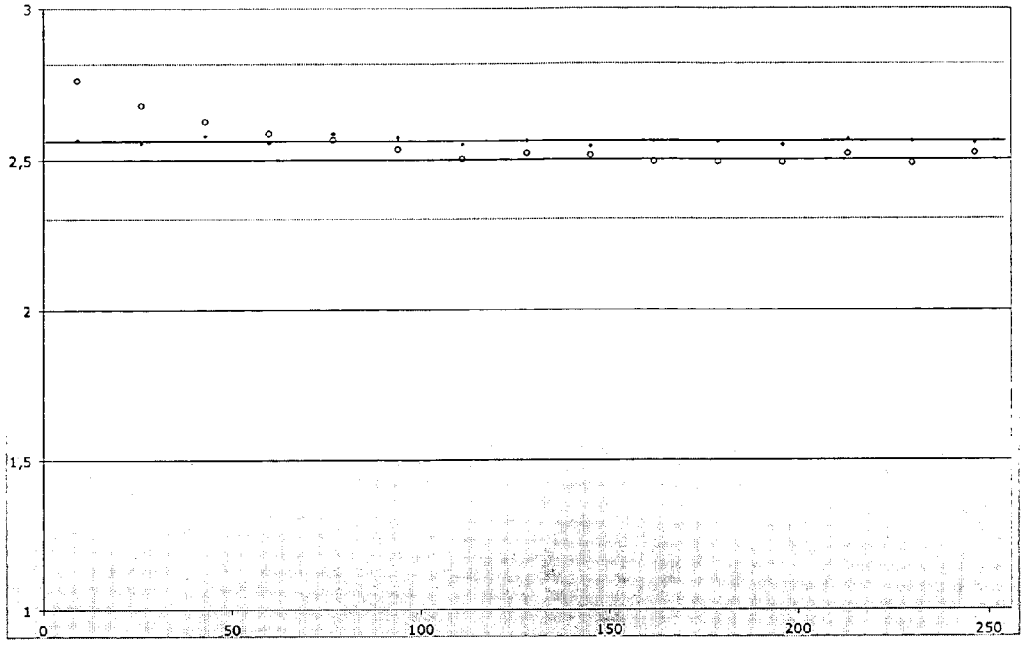
FIG. 6*c* shows the same comparison for DL/L in function of JND index and FIG. 6*d* shows the same comparison for number of JNDs per step in function of p-value.
Figure 6D:
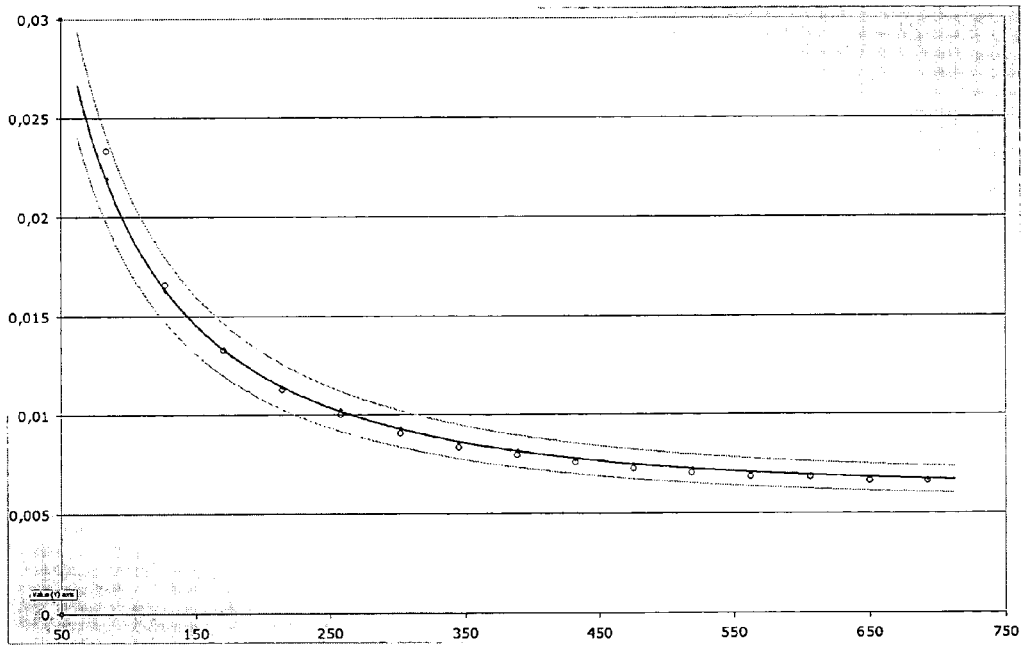
Figure 7A:
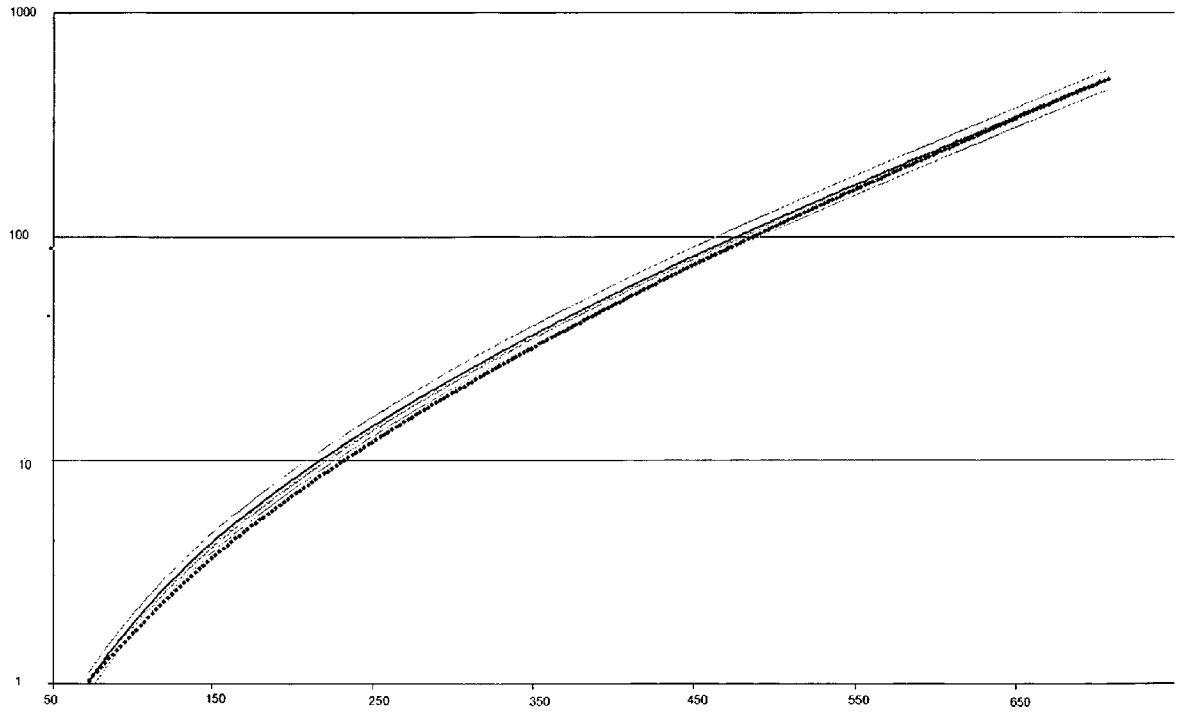
FIG. 7*a*, FIG. 7*b* and FIG. 7*c* show plots corresponding to FIG. 6*a*, FIG. 6*c* and FIG. 6*d* respectively, but now for off-axis viewing.
Figure 7B:
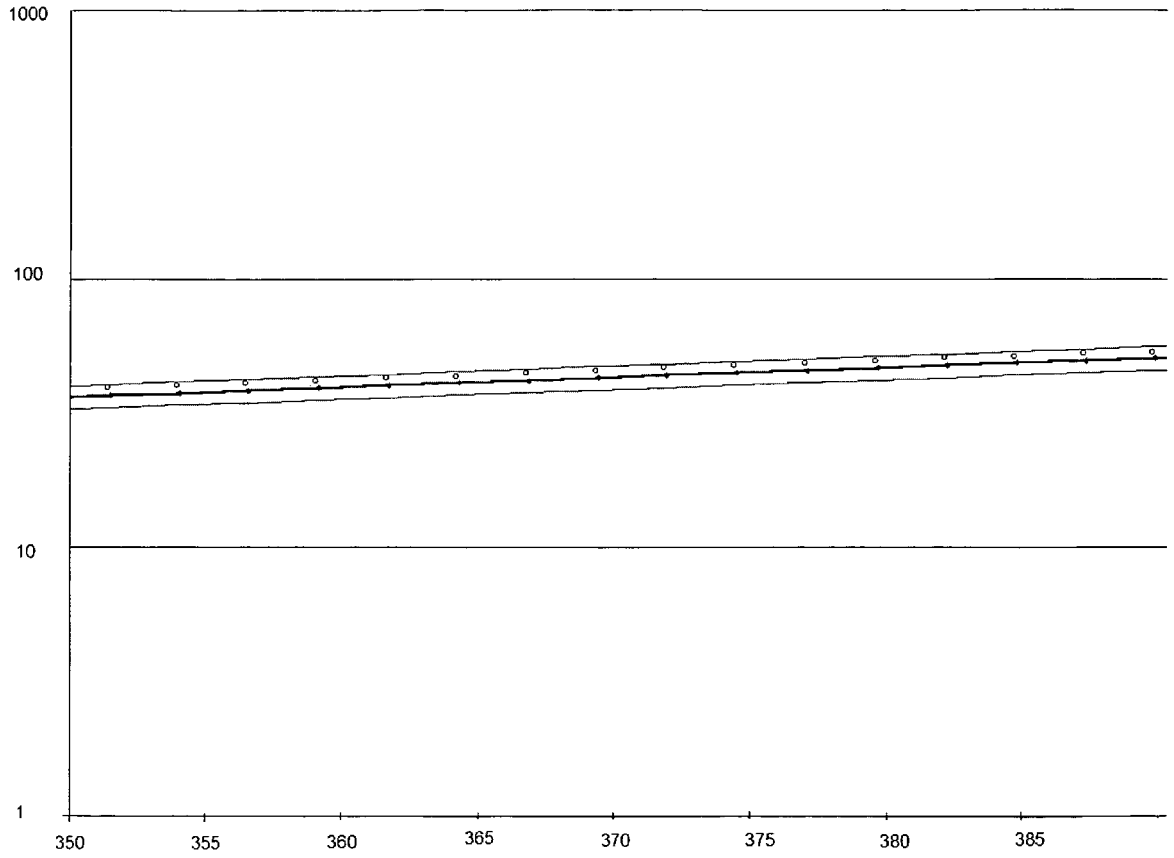
Figure 7C:
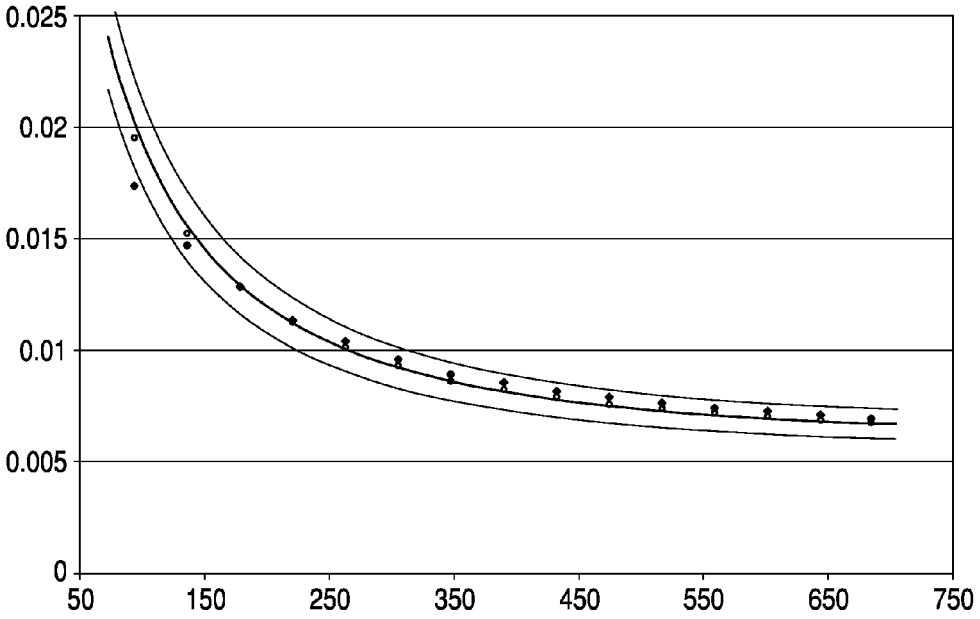
Fig. 7c PRIOR ART
Figure 9:
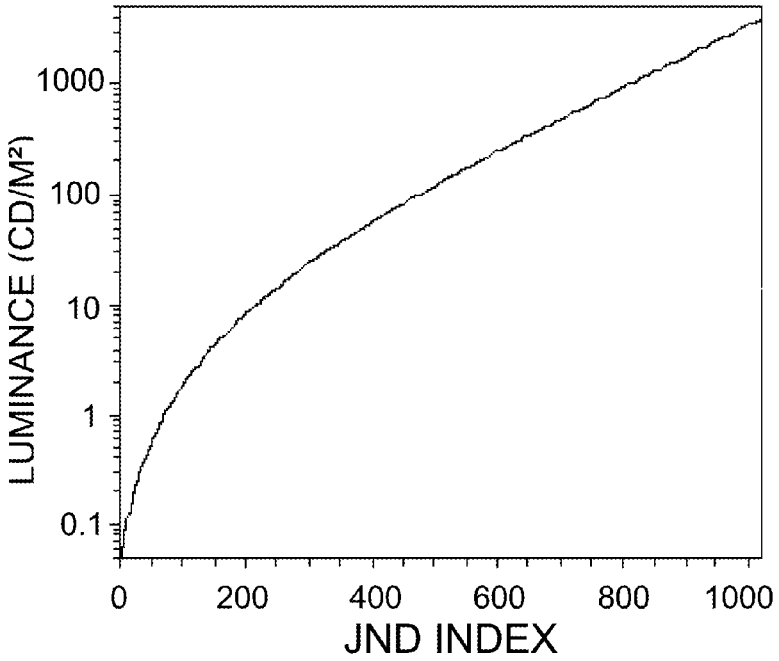
FIG. 9 is a graphical representation of the prior art Greyscale Standard Display Function (GSDF) presented as logarithm of Luminance versus JND-index.
Figure 8:
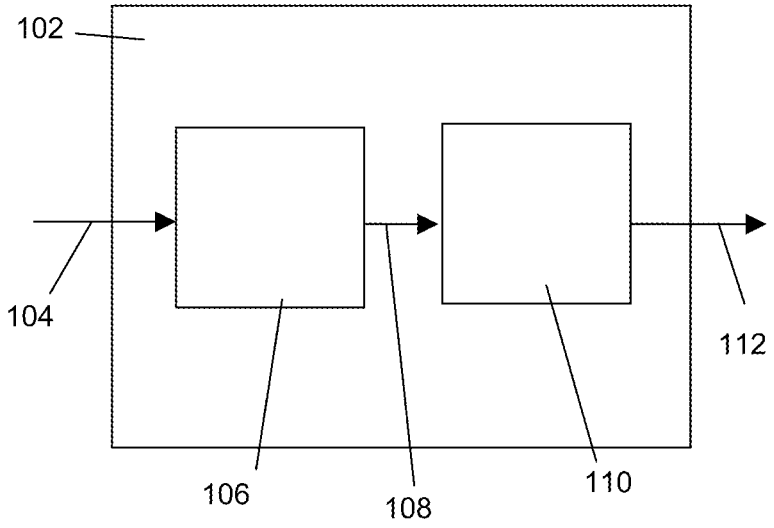
Fig. 8 PRIOR ART
FIG. 8 is a graphical representation of the conceptual model of a conventional standardised display system that matches P-values to Luminance via an intermediate transformation to digital driving levels of an unstandardised display system.
Figure 8:
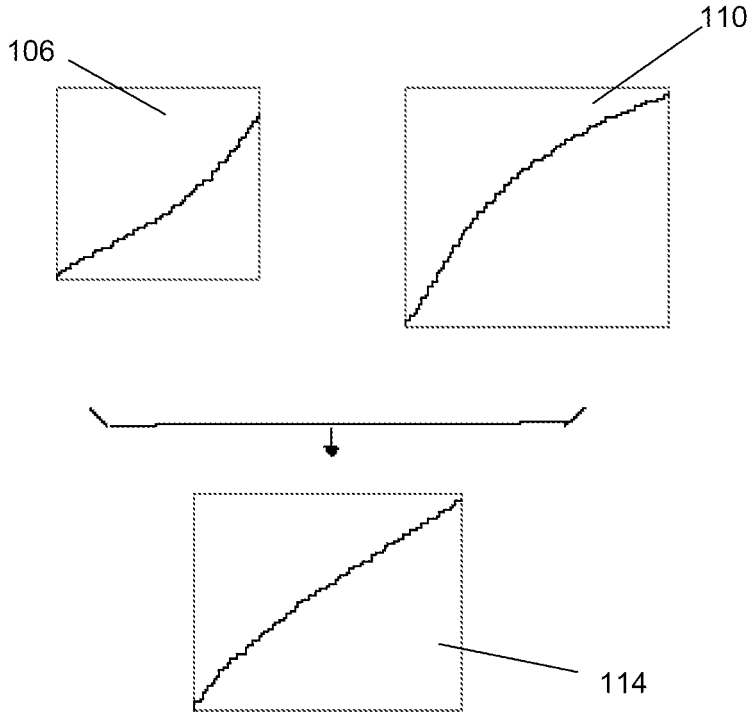
Fig. 8 PRIOR ART

As an example results are provided for a monochrome medical display system and compliance to the DICOM GSDF standard. FIGS. 6*a*, 6*b*, 6*c* and 6*d* compare the conformance to DICOM GSDF for normal on-axis calibration and our new calibration method and this for the three traditional DICOM conformance plots in case of on-axis viewing. FIGS. 6*a* and 6*b* (detail, zoomed area of FIG. 6*a*) show the target luminance curve and the luminance curves for the new method (circles) and the on-axis calibration method (squares). FIG. 6*c* shows the same comparison but for dL/L in function of JND index, and FIG. 6*d* shows the same comparison but for number of JNDs/step in function of p-value. What can be observed is that (as expected) the on-axis traditional calibration method performs best (gives best compliance to DICOM GSDF) since the calibration is done for on-axis viewing and the user is indeed looking to the display on-axis. However, the calibration method according to the present invention still is within the predefined tolerance of 10% so still DICOM GSDF compliant. FIGS. 7*a*, 7*b*, 7*c* show the plots corresponding to FIGS. 6*a*, 6*c*, 6*d* but now for not on-axis viewing, more particularly for viewing angle (90, 16), which is looking vertically down to the display under an angle of 16 degrees. What can be seen now in FIGS. 7*a*, 7*b* and 7*c* is that the normal on-axis calibration method (prior-art) results in non-compliance with the DICOM GSDF standard for a vertical viewing angle of 16 degrees. This can be seen for instance from FIGS. 7*a*, 7*b* and 7*c* where part of the curve of the normal on-axis calibration method is outside the +/−10% tolerance area compared to the DICOM GSDF target curves. The calibration method according to the present invention, however, is still within the +/−10% tolerance area and this for all three plots and all video levels (JND indices, p-values). This means that with the calibration method according to the present invention a calibration lookup-table has been created that results into compliance with DICOM GSDF and this both for on-axis viewing and for viewing under angle (90, 16) at the same time with the same calibration lookup-table. Similar plots can be created for other viewing angles. The conclusion is that for viewing angles close to on-axis viewing the on-axis calibration method will result into slightly better compliance to DICOM GSDF but non-compliance for larger viewing angles, while the method according to the present invention will result in slightly worse compliance to DICOM GSDF (but still compliance) for small viewing angles but at the advantage of compliance for much larger angles compared to the traditional calibration methods. As an example FIG. 5 shows the angles for which the display system is compliant to DICOM GSDF (within the 10% tolerance for all three plots) and this for traditional on-axis calibration (central region) and the new method (larger region). What can be seen is that the viewing cone for which the display is conforming to the standard has been approximately doubled, and this just by calibrating the display in another way.

For completeness a number of extensions and improvements to the basic algorithms and methods will be described. A first improvement is the combination of determination of an actual value of the parameter, e.g. a head-tracking system for determining the viewing angle, with the new method of calibrating the display. If a head tracking system is used to determine the position of the user, and therefore the angle under which the user is looking at the display, then based on this angle an optimal preset can be selected (automatically) so that the display system has optimal conformance to the selected display standard and this for the viewing angles around the current viewing angle. The advantage of this system is that inaccuracies in the head tracking system do not immediately result into non-conformance of the display system. Also there is no more need to have a head tracking system that is very fast, as a latency of the head tracking system does not result into a non-compliance to the selected display standard as there is a region around the "current" viewing angle for which the display is conforming to the standard. In case the user "slowly" changes position then this gives the head tracking system more time to come to a new (more or less accurate) head position. In case head-tracking is present one could also combine the present invention with a warning (visual, sound, . . . ) if the user is looking at the display from an angle for which standard compliance cannot be guaranteed.

Figure 12:
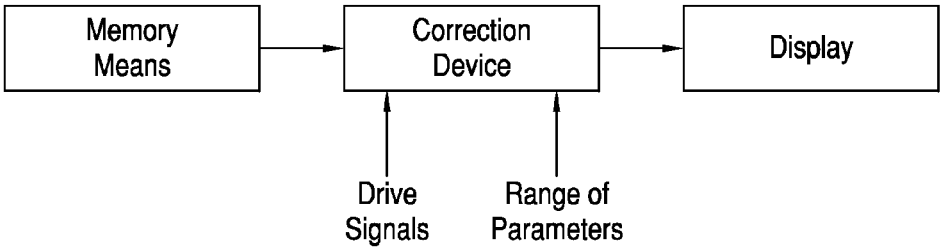
FIG. 12 is an illustration of a system for correcting nonconformance in grayscale or color values.

A system for correcting non-conformance in greyscale or colour values of at least one zone of emissive elements in a matrix display is schematically illustrated in FIG. 12. The correcting is performed with respect to at least one enforced greyscale or colour display standard. The system includes a memory means for storing characterisation data characterising the non-conformance in greyscale or colour values of the at least one zone of emissive elements as a function of its drive signals for a plurality of relevant values of at least a first parameter of the characterisation data. The system may further include a correction device for pre-correcting, based on an input value of the greyscale or colour value to be displayed and a selection of a range of at least the first parameter of the characterisation data for which non-conformance with respect to the at least one enforced greyscale or colour display standard is to be corrected within the pre-determined deviation range, and in accordance with the characterisation data, the drive signals of the at least one zone of emissive elements so as to obtain a greyscale or colour level conform the enforced greyscale or colour display standard within a predetermined deviation range from each of the at least one enforced greyscale or colour display standards. The system illustrated in FIG. 11 may still further include a characterising device for generating characterisation data for the at least one zone of emissive elements by establishing a relationship between the greyscale or colour levels of each of the at least one zone of emissive elements and the corresponding drive signal for a plurality of relevant parameter values in the parameter range for at least the first parameter. The characterising device may include an image capturing device for generating an image of the emissive elements of the matrix display.

Another improvement is to take also into account that different regions on the display can have different parameter values, e.g. can be viewed from different angles, at one particular moment. One example is the situation where a user is looking from close distance to a display system. In this situation the centre area of the display will be looked at on-axis, while closer to the corners it is clear that the user is looking at these areas under an angle. Therefore an extension to the previously described calibration algorithm is that one also takes into account these different angles. This problem can be solved by dividing the display area into different regions and for each of the regions a different collection of angles for which compliance is required can be selected. For each of those regions the optimisation problem can be solved independently, although knowledge on the optimal solution in one region will help to find the optimal solution for another neighbouring region (or region with similar collection of angles for which compliance is needed) much faster if the search space is limited to solutions around the solution of the already processed region. To avoid visible artefacts at the borders of regions one can use spatial interpolation on the different solutions to calculate the optimal calibration curve for each pixel instead of suddenly changing the calibration lookup-table from one display pixel to another display pixel if those pixels happen to be part of another region.

Yet another improvement is to take into account spatial variations (variations over the area of the panel) of the native transfer curve of the panel or take into account spatial variations (variations over the area of the panel) of the viewing angle behaviour of the panel. Similarly to the previous description, one could divide the display surface into regions, use different native curves or parameter behaviour data, e.g. viewing angle behaviour data, for each of the regions and solve the optimisation problem for each of those regions.

A more efficient implementation of the present invention could be that the native transfer curve of the panel and/or the parameter behaviour, e.g. viewing angle behaviour, of the panel and/or the solution of the optimisation problem for specific presets is stored in memory so that it is available when needed. This storage memory could be in the display itself, in the graphical board, in a computer system attached to the display or even remote on another system (retrieved over the internet for instance). The advantage of such an approach is that time consuming operations can be avoided: for example, if the viewing angle behaviour of the panel is stable over time then there is no need to re-measure this behaviour. One could store the viewing angle data, retrieve it and immediately use this when needed. Similarly one could even store previously calculated solutions (corresponding to often used presets or to previously custom created presets) so that computation time is avoided.

Another improvement is for displays that can be used in landscape and in portrait mode. In such situation it has of course no use to store native curves, viewing angle data, calculated calibration curves, . . . for landscape and portrait mode separately. This is because they are in fact equivalent if one takes into account that it is just one and the same display with a rotation of 90°.

Of course the present invention can be used in combination with other techniques to improve the viewing angle behaviour of display systems such as but not limited to optical compensation foils, dithering techniques such as described in "Low-cost Method to Improve Viewing-Angle Characteristics of Twisted-Nematic Mode Liquid-Crystal Displays" by S. L. Wright et al.

It is to be noted that the exact collection of parameters, e.g. viewing angles, for which conformance to the display standard is desired (and the weights assigned to those parameters, e.g. viewing angles) can have a significant impact on the existence and quality (conformance metric value) of the solution of the optimisation problem. Indeed, supposing a display system that has very good viewing angle behaviour for horizontal and vertical angles, but not for diagonal angles, if large diagonal angles are included in the collection of angles for which compliance is desired, then this could result into a poor solution of the optimisation problem. Therefore one could even add an extra layer on top of the optimisation problem as described earlier: one could also find the optimal collection of parameter values, e.g. viewing angles, in order to have compliance for instance in an as large as possible range of parameter values, e.g. viewing angles, with specific size and shape (as in FIG. 1).

As a final remark a comparison is made between the described algorithm and using a photometer with broad acceptance angle during calibration. Indeed, one could think that using a photometer with broad acceptance angle (for instance 10 degrees, or for instance equal to the typical acceptance angle of the human eye) will also result in conformance to the display standard for a broader range of viewing angles. However, this is not (necessarily) the case. If one thinks for instance on a (likely) situation where the average behaviour (over the acceptance angle of the photometer) is rather well compliant to a predefined standard, but behaviour for individual angles (or ranges of angles) is not conform, then using a photometer with broader acceptance angle will not improve the situation. This situation is rather typical since the luminance when viewing on-axis will be typically higher and the luminance when viewing off-axis will be typically lower compared to the luminance averaged over the acceptance angle of a (broad angle) photometer. One can also mathematically find a reason why using a broad acceptance angle photometer does not render the same results: when using a broad angle photometerone calibrates according to average display behaviour. The method of the present invention to the contrary will find a solution that is not based on "average" display behaviour but actually takes into account the real display behaviour for each individual viewing angle that is relevant. In other words: the present invention uses much more information/knowledge on the display system to be calibrated than the "average display behaviour". If one would use a photometer with acceptance angle 20 degrees for instance, and one would use an on-axis measurement of this photometer to calibrate the monochrome medical display system, then one will indeed see some improvement in compliance to the DICOM GSDF standard when viewing the display system off-axis. However, the method according to the present invention will result into a viewing cone of around 20 degrees which is compliant to DICOM GSDF, the method using a broad-angle photometer will result into a viewing cone of around 12 degrees which is compliant to DICOM GSDF and the normal method using a narrow-angle photometer will result into a viewing cone of around 8 degrees which is compliant to DICOM GSDF. Also it is to be noted that the method of using a broad-angle photometer does not allow to assign weights to specific viewing angles, in other words does not allow to specify the size or shape of the collection of viewing angles for which we desire compliance to the display standard.

However, it is also possible to optimise the design of the photometer (by modifying the acceptance angle, by creating a photometer that selectively only accepts light from a specific range or set of acceptance angles, even possibly with a controlled attenuation factor for well selected angles) in order to achieve compliance in a viewing cone that is as broad as possible. One example could be that one creates a photometer that accepts light for a range of horizontal angles between −20 degrees up to +20 degrees while the range of vertical angles for which the photometer accepts light is limited to −10 degrees up to +10 degrees. One could design that same photometer also to accept relatively more light for angles near to (horizontal angle, vertical angle) (0,0) which is equivalent to assigning a weight to each angle. Another example is that one could design the photometer to accept light as similar as possible to the way the human eye accepts light. Optimising the acceptance angle of the photometer is equivalent to selecting a well chosen set of angles possibly with weights assigned, such that if one calibrates the display system with that photometer then the conformance to the selected display standard will be as good as possible for a selected range of viewing angles. This is equivalent to the optimisation problem described earlier in this document but now the complexity has been shifted from "selecting the best display parameters" to "designing the acceptance angle of the photometer" such that a normal calibration procedure will result in best display performance over the selected range of one or more parameters such as viewing angle.

What is claimed is:

1. A method for calibrating a matrix display with respect to at least one enforced greyscale or color display standard, the method comprising:

selecting one or more standards to which the display needs to be compliant, choosing a viewing angle and selecting angles for which compliance is desired, obtaining a characterization, based on said at least one enforced greyscale or color standard, of a non-conformance in greyscale or color values of the matrix display with respect to a plurality of relevant values of the viewing angle, calculating a set of calibration parameters in function of the viewing angle, based n the at least one enforced greyscale or color display standard, and the characterized non-conformance in greyscale or color values of the matrix display, defining a degree of conformance of the matrix display with respect to the at least one enforced greyscale or color display standard, wherein the degree of conformance is a comparison of a relative deviation of an absolute value of a calculated value to an absolute target value of the enforced greyscale or color display standard, obtaining a same set of optimal calibration parameters valid for all values of the viewing angle and selected angles within a relevant viewing angle range by optimizing the set of calibration parameters with respect to said degree of conformance to the at least one enforced greyscale or color display standard for all values of the viewing angle within the relevant viewing angle range, wherein the relevant viewing angle range corresponds to a relevant range of different viewing positions, wherein optimizing the same set of calibration parameters comprises assigning for all values of the viewing angle range within the relevant viewing angle range a weight value to the degree of conformance corresponding to that viewing angle and based on at least two calibration parameters and at least two viewing angles, calculating said set of optimal calibration parameters, finishing the optimizing of the calibration parameters when its result falls within a predetermined deviation around the enforced at least one greyscale or color display standard, and using the obtained optimal calibration parameters with the matrix display, wherein within said relevant viewing angle range, the set of optimal calibration parameters replaces the set of calibration parameters.

2. The method according to claim 1, wherein characterizing the non-conformance in greyscale or color values of the matrix display with respect to the viewing angle comprises creating native transfer curves for the matrix display, and this for every value of the viewing angle within the relevant viewing angle range.

3. The method according to claim 2, wherein creating native transfer curves for every value of the viewing angle within the relevant viewing angle range comprises measuring native transfer curves for some values of the viewing angle within the relevant viewing angle range, and generating native transfer curves for other values of the first viewing angle by interpolation.

4. The method according to claim 1, wherein the relevant viewing angle range is a viewing cone of 20°.

5. The method according to claim 1, furthermore comprising configuring the matrix display with the set of optimal calibration parameters.

6. The method according to claim 5, wherein configuring the matrix display with the set of optimal calibration parameters comprises loading the set of optimal calibration parameters into the display, into a graphical board, into a host operating system or into an application running on the host operating system.

7. The method according to claim 1, wherein the set of optimal calibration parameters are in the form of a look-up table.

8. The method according to claim 1, wherein obtaining a characterization of the non-conformance in greyscale or color values of the matrix display with respect to relevant values of the viewing angle comprises characterizing the non-conformance in greyscale or color values of the matrix display with respect to relevant values of viewing angle.

9. The method according to claim 1, wherein obtaining a characterization of the non-conformance in greyscale or color values of the matrix display with respect to relevant values of the viewing angle comprises loading a previously determined characterization of the non-conformance in greyscale or color our values of the matrix display with respect to relevant values of the viewing angle.

10. The method according to claim 1, furthermore comprising determining an actual value of the viewing angle, and automatically selecting an optimal pre-set so that the display system has optimal conformance to the at least one enforced greyscale or color display standard with respect to the actual value of the viewing angle.

11. The method according to claim 1, there being a plurality of zones of emissive elements in the matrix display, at least two of the zones having a different value for the viewing angle at a particular moment in time, wherein the method comprises taking into account different relevant ranges of the viewing angle for at least two of the zones, and separately optimizing the set of calibration parameters of these at least two zones with respect to a degree of conformance to the at least one enforced greyscale or color display standard for all values of the viewing angle within the viewing angle range relevant for that zone, thus obtaining a set of optimal calibration parameters for use with the matrix display.

12. The method according to claim 1, wherein the characterization of the non-conformance in greyscale or color values of the matrix display is a function of drive signals with respect to the plurality of relevant values of the viewing angle of at least a first parameter.

13. A calibration device for calibrating a matrix display with respect to at least one enforced greyscale or color display standard, the calibration device comprising:

means for selecting one or more standards to which the display needs to be compliant, means for choosing a viewing angle and selecting angles for which compliance is desired, first storage means for storing a characterization, based on said at least one enforced greyscale or color standard, of a non-conformance in greyscale or color values of the matrix display with respect to a plurality of relevant values of the viewing angle, second storage means for storing a set of calibration parameters in function of the viewing angle, based on the at least one enforced greyscale or color display standard, and the characterized non-conformance in greyscale or color values of the matrix display, calculation means for obtaining a same set of optimal calibration parameters valid for all values of the viewing angle and selected angles within a relevant viewing angle range by optimizing the set of calibration parameters with respect to a degree of conformance to the at least one enforced greyscale or color display standard for all values within the relevant viewing angle range, wherein the degree of conformance is a comparison of a relative deviation of an absolute value of a calculated value to an absolute target value of the enforced greyscale or color display standard, wherein the set of calibration parameters is optimized by assigning for all values of the viewing angle within the relevant viewing angle range a weight value to the degree of conformance corresponding to that viewing angle and calculating said set of optimal calibration parameters based on at least two calibration parameters and at least two viewing angles, wherein the relevant viewing angle range corresponds to a relevant range of different viewing positions, means for finishing the optimizing of the calibration parameters when its result falls within a predetermined deviation around the enforced at least one greyscale or color display standard, and wherein the set of optimal calibration parameters for use with the matrix display is obtained, wherein within said relevant viewing angle range, the set of optimal calibration parameters replaces the set of calibration parameters.

14. The device according to claim 13, furthermore comprising means for creating native transfer curves for the matrix display, and this for every value of the viewing angle within the relevant viewing angle range.

15. The device according to claim 14, wherein the means for creating native transfer curves for every value of the viewing angle within the relevant viewing angle range comprises measurement means for measuring native transfer curves for some values of the viewing angle within the relevant viewing angle range, and calculation means for generating native transfer curves for other values of the viewing angle by interpolation.

16. The device according to claim 13, wherein the relevant viewing angle range is a viewing cone of 20°.

17. The device according to claim 13, furthermore comprising configuration means for configuring the matrix display with the set of optimal calibration parameters.

18. The device according to claim 17, wherein the configuration means comprises means for loading the set of optimal calibration parameters into the display, into a graphical board, into a host operating system or into an application running on the host operating system.

19. The device according to claim 13, furthermore comprising a third storage means for storing pre-sets of optimal calibration parameters for pre-determined viewing angle values.

20. The device according to claim 19, furthermore comprising means for determining an actual value of the viewing angle, and selection means for automatically selecting an optimal pre-set from the third storage means so that the display system has optimal conformance to the at least one enforced greyscale or color display standard with respect to the actual value of the viewing angle.

21. A method for correcting non-conformance in greyscale or color values of at least one zone of emissive elements in a matrix display, the correcting being with respect to at least one enforced greyscale or color display standard, the method comprising:

choosing a viewing angle and selecting angles for which compliance is desired, storing characterization data characterizing, based on said at least one enforced grevscale or color standard, a non-conformance in greyscale or color values of the at least one zone of emissive elements for a plurality of relevant values of the viewing angle of the characterization data, pre-determining a deviation range of non-conformance of the matrix display with respect to at least one enforced greyscale or color display standard, correcting, in accordance with the characterization data, said at least one zone of emissive elements so as to obtain a greyscale or color level conforming to said enforced greyscale or color display standard within said pre-determined deviation range from each of the at least one enforced greyscale or color display standards, wherein said correcting is performed based on an input value of the greyscale or color value to be displayed and a selection of a range of the viewing angle of the characterization data for which non-conformance with respect to the at least one enforced greyscale or color display standard is to be corrected within the pre-determined deviation range, and wherein said correcting is performed by obtaining a same set of optimal calibration parameters valid for all values of the viewing angle within a relevant viewing angle range for the at least one zone of emissive elements by optimizing the set of optimal calibration parameters to be valid for all values of the viewing angle and selected angles within the relevant range of viewing angles with respect to a degree of conformance to the at least one enforced greyscale or color display standard, the calibration parameters being optimized by assigning for all values of the viewing angles within the relevant viewing angle range a weight value to the degree of conformance corresponding to that viewing angle and calculating said set of optimal calibration parameters based on at least two calibration parameters and at least two viewing angles, wherein the degree of conformance is a comparison of a relative deviation of an absolute value of a calculated value to an absolute target value of the enforced greyscale or color display standard, finishing the optimizing of the calibration parameters when its result falls within a predetermined deviation around the enforced at least one greyscale or color display standard, and using said set of optimal calibration parameters, with the matrix display, wherein within said relevant viewing angle range, the set of optimal calibration parameters replaces the set of calibration parameters, wherein the relevant viewing angle range corresponds to a relevant range of different viewing positions.

22. The method according to claim 21, wherein the range of the viewing angle includes at least one of a range of viewing angles under which the at least one zone of emissive elements is or is to be viewed at, a range of at least one display related parameter, or a range of at least one environmental parameter.

23. The method according to claim 22, wherein the display related parameter includes one or more of matrix display temperatures, backlight luminance, backlight color temperature, display settings, calibration tables, graphical board settings, settings of a host operating system, settings of an application running on a host operating system.

24. The method according to claim 22, wherein the environmental parameter includes any of intensity of ambient light, color temperature of ambient light, ambient temperature the matrix display is or is to be used at, ambient light values the matrix display is or is to be used at.

25. The method according to claim 21, wherein the predetermined deviation range comprises a deviation up to 2%, preferably up to 5%, more preferably up to 10%, from the at least one enforced greyscale or color display standard.

26. The method according to claim 21, there being a plurality of zones of emissive elements, wherein each zone of emissive elements is corrected by a different calibration function.

27. The method according to claim 21, wherein a zone of emissive elements consists of one emissive element.

28. The method according to claim 21, wherein a zone of emissive elements comprises a plurality of emissive elements, each emissive element of a zone being assigned a same characterization data.

29. The method according to claim 21, wherein said correcting is performed based on using a look-up table.

30. The method according to claim 21, wherein said correcting is performed at least partially based on using a mathematical function.

31. The method according to claim 21, wherein the correcting is carried out in real-time.

32. The method according to claim 21, wherein the correcting is carried out off-line.

33. A system for correcting non-conformance in greyscale or color values of at least one zone of emissive elements in a matrix display, the correcting being with respect to at least one enforced greyscale or color display standard, the system comprising:

means for selecting one or more standards to which the display needs to be compliant, means for choosing a viewing angle and for selecting angles for which compliance is desired, a memory means for storing characterization data characterizing, based on said at least one enforced greyscale or color standard, a non-conformance in greyscale or color values of the at least one zone of emissive elements as a function of its drive signals for a plurality of relevant values of the viewing angle of the characterization data, a correction device for correcting, based on an input value of the greyscale or color value to be displayed and a selection of a range of the viewing angle of the characterization data for which non-conformance with respect to the at least one enforced greyscale or color display standard is to be corrected within a pre-determined deviation range, and in accordance with the characterization data, the drive signals of said at least one zone of emissive elements so as to obtain a greyscale or color level conform said enforced greyscale or color display standard within a pre-determined deviation range from each of the at least one enforced greyscale or color display standards, wherein the correction device performs correction by obtaining a same set of optimal calibration parameters valid for all values of the viewing angle within a relevant viewing angle range for the at least one zone of emissive elements by optimizing the set of optimal calibration parameters to be valid for all values of the viewing angles within the relevant range of viewing angles with respect to a degree of conformance to the at least one enforced greyscale or color display standard, the calibration parameters being optimized by assigning for all values of the viewing angles within the relevant viewing angle range a weight value to the degree of conformance corresponding to that viewing angle and calculating said set of optimal calibration parameters based on at least two calibration parameters and at least two viewing angles, wherein the degree of conformance is a comparison of a relative deviation of an absolute value of a calculated value to an absolute target value of the enforced greyscale or color display standard, means for finishing the optimizing of the calibration parameters when its result falls within a predetermined deviation around the enforced at least one greyscale or color display standard, wherein, when used with the matrix display within said relevant viewing angle range, the set of optimal calibration parameters replaces the set of calibration parameters, and wherein the relevant viewing angle range corresponds to a relevant range of different viewing positions.

34. The system according to claim 33, furthermore comprising a characterizing device for generating characterization data for the at least one zone of emissive elements by establishing a relationship between the greyscale or color levels of each of said at least one zone of emissive elements and the corresponding drive signal for a plurality of relevant parameter values in the range for the viewing angle.

35. The system according to claim 34, wherein said characterizing device comprises an image capturing device for generating an image of the emissive elements of the matrix display.

36. A method for calibrating a matrix display with respect to at least one enforced greyscale or color display standard, the method comprising:

choosing a viewing angle and selecting angles for which compliance is desired, obtaining a characterization, based on said at least one enforced greyscale or color standard, of a non-conformance in greyscale or color values of the matrix display with respect to a plurality of relevant values of the viewing angle, calculating a set of calibration parameters in function of the viewing angle, based on the at least one enforced greyscale or color display standard, and the characterized non-conformance in greyscale or color values of the matrix display, defining a degree of conformance of the matrix display with respect to at least one enforced greyscale or color display standard, wherein the degree of conformance is a comparison of a relative deviation of an absolute value of a calculated value to an absolute target value of the enforced greyscale or color display standard, obtaining a single set of optimal calibration parameters valid for a relevant range of viewing positions by optimizing the set of calibration parameters with respect to said degree of conformance to the at least one enforced greyscale or color display standard, finishing the optimizing of the calibration parameters when its result falls within a predetermined deviation around the enforced at least one greyscale or color display standard and using said set of optimal calibration parameters with the matrix display, and using the obtained optimal calibration parameters with the matrix display, wherein within said relevant range of viewing positions, the single set of optimal calibration parameters replaces the set of calibration parameters.

* * * * *